US009476137B2

(12) United States Patent
Ohmi et al.

(10) Patent No.: US 9,476,137 B2
(45) Date of Patent: Oct. 25, 2016

(54) METAL OXIDE FILM, LAMINATE, METAL MEMBER AND PROCESS FOR PRODUCING THE SAME

(75) Inventors: Tadahiro Ohmi, Miyagi (JP); Yasuyuki Shirai, Miyagi (JP); Hitoshi Morinaga, Miyaga (JP); Yasuhiro Kawase, Miyagi (JP); Masafumi Kitano, Miyagi (JP); Fumikazu Mizutani, Fukuoka (JP); Makoto Ishikawa, Fukuoka (JP)

(73) Assignees: Tohoku University, Sendai-shi (JP); Mitsubishi Chemical Corporation, Tokyo (JP)

( * ) Notice: Subject to any disclaimer, the term of this patent is extended or adjusted under 35 U.S.C. 154(b) by 1102 days.

(21) Appl. No.: 13/463,315

(22) Filed: May 3, 2012

(65) Prior Publication Data

US 2012/0247961 A1 Oct. 4, 2012

Related U.S. Application Data

(62) Division of application No. 11/917,614, filed as application No. PCT/JP2006/309327 on May 9, 2006, now Pat. No. 8,206,833.

(30) Foreign Application Priority Data

Jun. 17, 2005 (JP) ..... 2005-178562
Mar. 9, 2006 (JP) ..... 2006-064923

(51) Int. Cl.
*C25D 11/06* (2006.01)
*C25D 11/18* (2006.01)

(52) U.S. Cl.
CPC ..... *C25D 11/06* (2013.01); *C25D 11/18* (2013.01); *Y10T 428/265* (2015.01)

(58) Field of Classification Search
CPC ..... C25D 11/04–11/10
See application file for complete search history.

(56) References Cited

U.S. PATENT DOCUMENTS 3,321,385 A * 5/1967 Fazzari ..... 205/148
3,734,784 A 5/1973 Bereday et al.

(Continued)

FOREIGN PATENT DOCUMENTS

CH 506 629 6/1971
JP 62-103377 5/1987

(Continued)

OTHER PUBLICATIONS

Al-Mill Specification from http://www.maxsteel.sg/pdf/aluminum_guide.pdf Dated Sep. 15, 2012.*

(Continued)

*Primary Examiner* — Nicholas A Smith
*Assistant Examiner* — Brian W Cohen
(74) *Attorney, Agent, or Firm* — Oblon, McClelland, Maier & Neustadt, L.L.P.

(57) ABSTRACT

A metal oxide film suitable for protection of metals, composed mainly of aluminum. A metal oxide film includes a film of an oxide of a metal composed mainly of aluminum, having a thickness of 10 nm or greater, and exhibiting a moisture release rate from the film of 1E18 mol./cm$^2$ or less. Further, there is provided a process for producing a metal oxide film, wherein a metal composed mainly of aluminum is subjected to anodic oxidation in a chemical solution of 4 to 10 pH value so as to obtain a metal oxide film.

11 Claims, 19 Drawing Sheets

(56) References Cited

U.S. PATENT DOCUMENTS

| | | | | |
|---|---|---|---|---|
| 3,767,541 | A * | 10/1973 | Curtis | C25D 11/10 205/322 |
| 3,864,219 | A * | 2/1975 | Dosch | C25D 11/02 205/210 |
| 4,045,302 | A | 8/1977 | Gibbs et al. | |
| 4,125,874 | A | 11/1978 | Higashide et al. | |
| 4,481,084 | A | 11/1984 | Chen et al. | |
| 4,615,747 | A | 10/1986 | Kato et al. | |
| 4,860,565 | A | 8/1989 | Kato et al. | |
| 5,141,603 | A | 8/1992 | Dickey et al. | |
| 5,595,638 | A * | 1/1997 | Konuma | C25D 11/02 205/106 |
| 5,736,434 | A | 4/1998 | Konuma et al. | |
| 5,756,222 | A | 5/1998 | Bercaw et al. | |
| 5,811,195 | A | 9/1998 | Bercaw et al. | |
| 5,951,787 | A | 9/1999 | Ohmi et al. | |
| 6,331,754 | B1 | 12/2001 | Satoyoshi et al. | |
| 6,368,485 | B1 * | 4/2002 | Ue et al. | 205/234 |
| 6,468,398 | B1 | 10/2002 | Kumamoto et al. | |
| 6,500,558 | B2 * | 12/2002 | Yamaguchi | 428/469 |
| 2002/0189776 | A1 | 12/2002 | Kumamoto et al. | |
| 2003/0148623 | A1 | 8/2003 | Ohmi et al. | |
| 2004/0144319 | A1 | 7/2004 | Nagayama et al. | |
| 2004/0232001 | A1 | 11/2004 | Ward et al. | |
| 2006/0037866 | A1 | 2/2006 | Yamamoto et al. | |
| 2010/0330390 | A1 | 12/2010 | Ohmi et al. | |

FOREIGN PATENT DOCUMENTS

| | | |
|---|---|---|
| JP | 01-312088 | 12/1989 |
| JP | 02-298335 | 12/1990 |
| JP | 03-072088 | 3/1991 |
| JP | 4-198497 | 7/1992 |
| JP | 5-25694 | 2/1993 |
| JP | 05-114582 | 5/1993 |
| JP | 05-053870 | 8/1993 |
| JP | 07-233476 | 9/1995 |
| JP | 08-181048 | 7/1996 |
| JP | 08-225991 | 9/1996 |
| JP | 8-311692 | 11/1996 |
| JP | 09-069514 | 3/1997 |
| JP | 09-184094 | 7/1997 |
| JP | 10-081997 | 3/1998 |
| JP | 10-130884 | 5/1998 |
| JP | 10-294470 | 11/1998 |
| JP | 11-043734 | 2/1999 |
| JP | 11-181595 | 7/1999 |
| JP | 11-302824 | 11/1999 |
| JP | 2001-73166 | 3/2001 |
| JP | 2001-104774 | 4/2001 |
| JP | 2001-135636 | 5/2001 |
| JP | 2002-177790 | 6/2002 |
| JP | 2002-180272 | 6/2002 |
| JP | 2002-237595 | 8/2002 |
| JP | 2002/299331 | 10/2002 |
| JP | 2002-356761 | 12/2002 |
| JP | 2003-166043 | 6/2003 |
| JP | 2003-179037 | 6/2003 |
| JP | 2004-060044 | 2/2004 |
| JP | 2005-105300 | 4/2005 |
| WO | WO 03/008672 A1 | 1/2003 |

OTHER PUBLICATIONS

M. Pourbaix, Atlas of Electrochemical Equilibria in Aqueous Solutions (translation), pp. 171-176, National Association of Corrosion Engineers, Houston, TX (1974).

J.R. Dickey, et al. "Improved Dielectric Properties for Anodic Aluminum Oxide Films by Soft/Hard Two-Step Electrolytic Anodization", J. Electrochem. Soc., vol. 136, No. 6, pp. 1772-1776 (Jun. 1989).

D. Edwards, Jr., "An Upper Bound to the Outgassing Rate of Metal Surfaces", J. Vac. Sci. Technol., vol. 14, No. 4., Jul./Aug. 1977.

ASM Specialty Handbook: Aluminum and Aluminum Alloys, pp. 441-465, 462-468, ed. J.R. Davis, ASM International (1993).

Y. Kawase, et al., "An Outgas Free Passivation Technology for Semiconductor Vacuum Chamber Using Advanced Anodic Oxidation", ECS Transactions, vol. 2, No. 9, 2007, pp. 67-71.

Yasuhiro Kawase, et al., "A Defect-Free Anodic Oxide Passivation for LSI/FPD Vacuum Chamber", 15$^{th}$ International Symposium on Semiconductor Manufacturing, Conference Proceedings, 2006, pp. 171-174.

Yasuhiro Kawase, et al., "Passivation Technology for Aluminum Surface Using Anodic Oxidation", IEICE Technical Report SDM 2006-193, 2006, pp. 81-86 (with English Abstract).

Yasuhiro Kawase, et al., "Surface Passivation of LSI/FPD Aluminum Alloy Chamber by Anodization", 18$^{th}$ International Micro Electronics Conference Proceedings, 2006, pp. 31-37 (with English Abstract).

Office Action issued on Jun. 29, 2011 in the corresponding Japanese Application No. 2007-521220 (with English Translation).

Extended European Search Report issued Dec. 2, 2011, in European Patent Application No. 06746158.2.

Office Action issued Oct. 17, 2012 in European Patent Application No. 06 746 158.2.

Office Action issued on Nov. 22, 2013 in the corresponding European Application No. 06 746 158.2-1360.

Office Action issued Apr. 24, 2013 in Japanese Application No. 2011-278405 (With English Translation).

* cited by examiner

A3062 Material

HQ Material x 10000

A5052 Material

HQ Material

METAL OXIDE FILM, LAMINATE, METAL MEMBER AND PROCESS FOR PRODUCING THE SAME

The present application is a Divisional application of Ser. No. 11/917,614, now allowed, which is a national stage application of PCT/JP06/309327 which claims benefit of priority to Japanese patent applications 2005-178562 having a filing date of Jun. 17, 2005 and 2006-064923 having a filing date of Mar. 9, 2006.

TECHNICAL FIELD

This invention relates to a metal oxide film, a laminate, a metal member, and their manufacturing methods and, in particular, relates to a metal oxide film, a laminate, and a metal member suitable for use in a manufacturing apparatus used in the manufacturing process of an electronic device such as a semiconductor or a flat panel display, and to methods of manufacturing them.

BACKGROUND ART

In recent years, instead of stainless materials, lightweight and strong metals each containing aluminum as the main component have been widely used as structural materials of manufacturing apparatuses for use in the fields of manufacturing electronic devices such as semiconductors and flat panel displays, and so on, i.e. vacuum thin-film forming apparatuses for use in chemical vapor deposition (CVD), physical vapor deposition (PVD), vacuum deposition, sputtering, microwave-excited plasma CVD, and so on, dry etching apparatuses for use in plasma etching, reactive ion etching (RIE), recently-developed microwave-excited plasma etching, and so on (hereinafter collectively referred to as vacuum apparatuses), cleaning apparatuses, burning apparatuses, heating apparatuses, and so on, having surfaces brought into contact with particularly corrosive fluids, radicals, or irradiated ions. In order to realize future efficient multi-kind small-quantity production, these apparatuses are each required to shift to a three-dimensional cluster tool capable of carrying out a plurality of processes for itself, each required to carry out a plurality of processes by switching the kind of gas in a single process chamber, or the like. Among practical metals, aluminum belongs to a particularly base group and, therefore, aluminum or a metal containing aluminum as the main component requires protective film formation by a proper surface treatment.

As a surface protective film when a metal containing aluminum as the main component is used as a structural material, there is conventionally known an anodized film (alumite) obtained by anodic oxidation in an electrolyte solution. If use is made as the electrolyte solution of an acid electrolyte solution (normally pH 2 or less), it is possible to form a smooth and uniform alumite coating film having a porous structure.

Further, alumite coating films are corrosion-resistant and acid electrolyte solutions are stable and easy to manage, and therefore, the alumite coating films are generally and widely used. However, an alumite coating film having a porous structure is weak against heat as a treated surface of a structural member and thus causes cracks due to a difference in thermal expansion coefficient between the aluminum base member and the alumite coating film (Patent Document 1—Japanese Unexamined Patent Application Publication (JP-A) No. H10-130884), thereby causing occurrence of particles and occurrence of corrosion and so on due to exposure of the aluminum base member.

Further, large amounts of water and so on are accumulated/adsorbed in holes of the porous structure (Patent Document 2—Japanese Examined Patent Application Publication (JP-B) No. H5-053870) and these are released in large quantities as outgas components to cause many problems such as a large reduction in the performance of a vacuum apparatus, operation failure of devices, occurrence of corrosion of the alumite coating film and the aluminum base member due to coexistence with various gases including a halogen gas and chemicals, and so on. Among halogen gases, particularly a chlorine gas is used as an etching gas in the processing, such as reactive ion etching (RIE), of a metal material and is also used in a cleaning process of a thin film forming apparatus or a dry etching apparatus and, therefore, it is important to achieve a metal surface treatment of an apparatus member that can ensure strong corrosion resistance against the chlorine gas.

In view of this, there are various proposals for alumite coating films each with a low increase rate of cracks caused by a high-temperature heat load and their forming methods. For example, there is proposed a method of forming an alumite coating film with a controlled aluminum alloy composition (Patent Document 3—Japanese Unexamined Patent Application Publication (JP-A) No. H11-181595). However, this alumite coating film also has a porous structure on the surface like the conventional one and various problems due to water remaining in holes of the porous structure remain outstanding.

Various methods are proposed for improving the problems caused by this porous structure. For example, there are proposed a sealing treatment in which an alumite coating film with a porous structure anodized in an acid electrolyte is immersed in boiling water or treated in pressurized steam, thereby forming aluminum hydroxide (boehmite layer) on the surface to fill holes (Patent Document 4—Japanese Unexamined Patent Application Publication (JP-A) No. H5-114582), a sealing treatment in a solution containing a hydrate or hydrated oxide of a metal as the main component (Patent Document 5—Japanese Unexamined Patent Application Publication (JP-A) No. 2004-060044), and so on. However, water still remains in holes of the porous structure even after the sealing treatment and the boehmite layer of aluminum hydroxide itself is also a hydrate and thus serves as a water supply source depending on the conditions such as a pressure and a temperature and, therefore, a radical solution has not yet been reached. There is also proposed a method of performing barrier-structure anodic oxidation after forming a porous-structure alumite coating film (Patent Document 6—Japanese Unexamined Patent Application Publication (JP-A) No. 2005-105300). However, since it is necessary to perform the anodic oxidation in the two processes, there is a problem that the manufacturing cost increases.

Besides, as a surface treatment when a metal containing aluminum as the main component is used as a structural member, use is made of a thermal spraying method that melts and sprays a powder material of a metal, an alloy, a ceramic, or a combination of the ceramic and the metal or the alloy (Patent Document 7—Japanese Unexamined Patent Application Publication (JP-A) No. H9-069514). However, in the surface treatment by the thermal spraying method, there remains a problem in that since it is difficult to suppress formation of pores where the film surface and the base member communicate with each other through holes, when a corrosive gas such as a halogen gas is used in an apparatus, portions of the metal, containing aluminum as the main component, of the base member, that are brought into contact with the corrosive gas through the pores, are subjected to corrosion.

DISCLOSURE OF THE INVENTION

Problem to be Solved by the Invention

That is, the alumite coating film formed by the acid electrolyte solution has the problem of remaining/adsorbed water, it is difficult to completely suppress the formation of voids or the formation of gas pools by the method of performing the barrier-structure anodic oxidation after forming the porous-structure alumite coating film, and it is difficult to suppress the formation of pores by the surface treatment using the thermal spraying method. The alumite coating film has an $Al_2O_3.6H_2O$ structure containing water and, further, since the alumite coating film becomes porous due to etching of the film by OH ions produced by electrolysis of the anodization solution, a large amount of water is contained there and, if it is used, for example, in an RIE apparatus, a large amount of water is released into a chamber during etching so as to form a water plasma. Since this water plasma produces OH radicals to decompose a photoresist, the selectivity between the resist and a material to be etched largely decreases and therefore the resist should be formed thick in the conventional RIE. This causes a problem of reduction in resolution. Further, the large amount of water released into the chamber aggregates ions in the chamber by gas-phase reactions to generate a large amount of dust in the chamber, thereby causing a reduction in yield of devices. Since the RIE is normally performed at 20 to 40 mTorr, the distances between gas molecules are sufficiently large and thus the gas-phase reactions do not occur, so that the dust cannot be generated. However, actually, there arises a problem that a large amount of dust is generated and the dust adheres to a gate valve, so that the dust adheres to wafers when taking them in and out, thus resulted in production of defective products. This is because the dust is generated due to the interposition of water.

Even if attempting to carry out a heat treatment to release the water of the conventional alumite, since the alumite is subjected to formation of cracks at 140° C., it is not possible to reduce the water by the heat treatment.

It is therefore an object of this invention to provide a metal oxide film with no film defects such as fine holes or pores, thus with a small water release amount, and capable of protecting a metal containing aluminum as the main component, and a manufacturing method thereof.

It is another object of this invention to provide a metal member having a metal oxide film with no film defects such as fine holes or pores capable of protecting a metal containing aluminum as the main component, and a manufacturing method thereof.

It is another object of this invention to provide a metal member having a metal oxide film with no film defects such as fine holes or pores, thus with a small water release amount, and further, subjected to no crack formation even in a heat treatment at 150° C. or more and capable of protecting a metal containing aluminum as the main component, and a manufacturing method thereof.

Means for Solving the Problem

The present inventors have assiduously studied for accomplishing the foregoing objects and found that a metal oxide film that is a thin film and exhibits a water release amount from the film being a predetermined amount or less can suppress occurrence of cracks in the oxide film due to heating, release of outgas, and so on and has excellent corrosion resistance against a halogen gas, particularly a chlorine gas, and that a metal oxide film having excellent properties is obtained using a specific anodization solution.

That is, according to this invention, there is obtained a metal oxide film characterized by being a film formed of an oxide of a metal containing aluminum as the main component, having a thickness of 10 nm or more, and exhibiting a water release amount from the film of 1E18 molecules/$cm^2$ or less ($1\times10^{18}$ molecules/$cm^2$ or less). In the following description, the number of molecules is given by the E-Notation.

Further, it has been found that, in a metal in which aluminum is the main component and the content of specific elements is suppressed, a metal oxide film formed by using a specific anodization solution has excellent corrosion resistance against a chemical solution such as nitric acid or hydrofluoric acid and a halogen gas, particularly a chlorine gas, because no voids or gas pools are formed and occurrence of cracks in the oxide film due to heating and so on are suppressed.

In this invention, the thickness of the metal oxide film can be measured by a transmission electron microscope or a scanning electron microscope. For example, JSM-6700 produced by JEOL Ltd. or the like can be used.

In this invention, the water release amount from the metal oxide film represents the number of released water molecules per unit area [molecules/$cm^2$] released from the film while the metal oxide film is kept at 23° C. for 10 hours, then raised in temperature and kept at 200° C. for 2 hours (measurement is effective also during the temperature rise). The water release amount can be measured, for example, using an atmospheric pressure ionization mass spectrometry apparatus (UG-302P produced by Renesas Eastern Japan).

Preferably, the metal oxide film is obtained by anodizing the metal containing aluminum as the main component or the metal containing high-purity aluminum as the main component in an anodization solution of pH 4 to 10. The anodization solution preferably contains at least one kind selected from the group consisting of boric acid, phosphoric acid, organic carboxylic acid, and salts thereof. Further, the anodization solution preferably contains a nonaqueous solvent. Preferably, a heat treatment is carried out at 100° C. or more after the anodic oxidation. For example, it is possible to anneal the metal oxide film in a heating furnace at 100° C. or more. This metal oxide film is preferably used as a coating film for protecting a structural member of a semiconductor or flat panel display manufacturing apparatus.

Further, according to this invention, there is obtained a laminate characterized by comprising this metal oxide film on a base body formed of the metal containing aluminum as the main component or the metal containing high-purity aluminum as the main component. This laminate is preferably used as a structural member of a semiconductor or flat panel display manufacturing apparatus.

According to necessity, another layer may be provided on the upper or lower side of the metal oxide film of this invention. For example, a thin film using one kind or two or more kinds selected from a metal, a cermet, and a ceramic as a material thereof may be further formed on the metal oxide film, thereby obtaining a multilayer structure.

Further, according to this invention, there is obtained a semiconductor or flat panel display manufacturing apparatus using such a laminate.

Further, according to this invention, there is obtained a metal oxide film manufacturing method characterized by anodizing a metal containing aluminum as the main component or a metal containing high-purity aluminum as the main component in an anodization solution of pH 4 to 10, thereby obtaining a film formed of an oxide of the metal containing aluminum as the main component or the metal containing high-purity aluminum as the main component.

The anodization solution preferably contains at least one kind selected from the group consisting of boric acid, phosphoric acid, organic carboxylic acid, and salts thereof. Further, the anodization solution preferably contains a non-aqueous solvent.

The metal oxide film is preferably heat-treated at 150° C. or more after the anodic oxidation. Preferably, the obtained metal oxide film has a thickness of 10 nm or more and the water release amount from the film is 1E18 molecules/$cm^2$ or less. This water release is resulted from water adsorbed on the surface of the metal oxide film and the water release amount is proportional to the effective surface area of the metal oxide film, and therefore, it is effective to minimize the effective surface area for reducing the water release amount. Accordingly, the metal oxide film is desirably a barrier-type metal oxide film with no pores or the like on the surface. The metal oxide film is used as a coating film for protecting a structural member of a semiconductor or flat panel display manufacturing apparatus.

Further, according to this invention, there is obtained a laminate manufacturing method characterized by anodizing a base body made of a metal containing aluminum as the main component in an anodization solution of pH 4 to 10, thereby forming a film made of an oxide of the metal containing aluminum as the main component on the base body.

The metal containing aluminum as the main component represents a metal containing 50 mass % or more aluminum. It may also be pure aluminum. This metal contains aluminum in an amount of preferably 80 mass % or more, more preferably 90 mass % or more, and further preferably 94 mass % or more. The metal containing aluminum as the main component preferably contains at least one kind of metal selected from the group consisting of magnesium, titanium, and zirconium.

The metal containing high-purity aluminum as the main component represents a metal containing aluminum as the main component, wherein the total content of specific elements (iron, copper, manganese, zinc, and chromium) is 1% or less. The metal containing high-purity aluminum as the main component preferably contains at least one kind of metal selected from the group consisting of magnesium, titanium, and zirconium.

Effect of the Invention

A faultless barrier-type oxide film, with no fine holes or pores, of a metal containing aluminum as the main component or a metal containing high-purity aluminum as the main component and a laminate having this film according to this invention exhibit excellent corrosion resistance against chemicals, corrosive fluids, and halogen gases, particularly a chlorine gas, and also have perfect resistance against all radicals such as hydrogen radicals, oxygen radicals, chlorine radicals, bromine radicals, and fluorine radicals and against ion irradiation in a plasma. Further, since cracks hardly occur in the metal oxide film even when heated to 150° C. to 500° C., it is possible to suppress generation of particles and corrosion due to exposure of the aluminum base body, thermal stability is high, and release of outgas from the film is small in amount. If it is used as a protective film of a structural member such as an inner wall of a vacuum apparatus such as a vacuum thin-film forming apparatus, the ultimate vacuum of the apparatus is improved and the quality of thin films manufactured is improved, thus leading to reduction in operation failure of devices having the thin films. Since there are provided surfaces that do not react with radicals, the process is stabilized. If the conventional alumite-protected aluminum is used in a plasma processing apparatus, there is a problem that since the thickness of the alumite film is large and thus the capacitance of the wall surface is large, large quantities of charge adhere thereto so that a plasma disappears due to recombination of ions and electrons, and therefore, the power consumption is large for plasma excitation. However, in the case of the aluminum oxide film of this invention, since the thickness of the film can be small, the capacitance is small and thus a plasma loss due to charge recombination is also small, and therefore, the power for plasma excitation can be reduced to ⅕ to 1/10 as compared with the conventional one. Further, since the release of water is as small as that of metal aluminum, there is no generation of water plasma even in an RIE apparatus and thus a photoresist is not damaged so that a large selectivity can be ensured. Consequently, the resist can be reduced in thickness to thereby achieve a large increase in resolution. Further, generation of dust is suppressed so that the yield is improved. In this invention, it is not essential to achieve all the effects, but is sufficient if one or more of the foregoing effects are exhibited.

Particularly, the oxide of the metal containing high-purity aluminum as the main component can properly suppress the formation of voids or the formation of gas pools in the barrier structure.

BEST MODE FOR CARRYING OUT THE INVENTION

Figure 1:
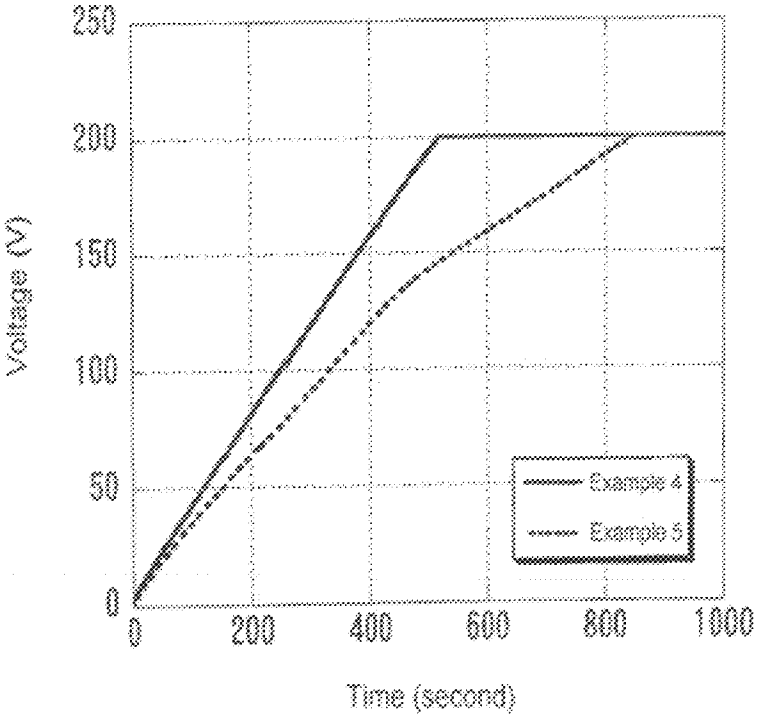
FIG. 1 is a graph showing the voltage characteristics during anodic oxidation in Examples 4 and 5.

Hereinbelow, this invention will be described in further detail.

A metal oxide film according to this invention is a film formed of an oxide of a metal containing aluminum as the main component or high-purity aluminum as the main component, having a thickness of 10 nm or more, and exhibiting a water release amount from the film of 1E18 molecules/cm$^2$ or less. This film exhibits high performance as a protective film when it is formed on a base body made of a metal containing aluminum as the main component.

The thickness of the metal oxide film is preferably set to as small as 100 μm or less. If the thickness is great, cracks tend to occur and outgas tends to be released. The thickness is more preferably set to 10 μM or less, further preferably to 1 μm or less, still further preferably to 0.8 μm or less, and particularly preferably to 0.6 μm or less. However, the thickness is set to 10 nm or more. If the thickness is too thin, sufficient corrosion resistance cannot be obtained. The thickness is preferably set to 20 nm or more and more preferably to 30 nm or more.

The water release amount from the metal oxide film is set to 1E18 molecules/cm$^2$ or less. If the water release amount is large, the water causes corrosion and, when used as a protective film of a structural member such as an inner wall of a vacuum apparatus or the like, the quality of a thin film to be manufactured is degraded. The water release amount is preferably set to 2E17 molecules/cm$^2$ or less and more preferably to 1E17 molecules/cm$^2$ or less. The water release amount is preferably as small as possible, but is normally 1.5E15 molecules/cm$^2$ or more.

A barrier-type metal oxide film with no fine holes or pores is suitable as such a metal oxide film. As compared with a conventionally used porous metal oxide film having a porous structure, the barrier-type metal oxide film has an advantage in that it is excellent in corrosion resistance while being thin and, since it has practically no fine holes or pores, water or the like is not easily adsorbed.

A metal oxide film of this invention is formed of an oxide of a metal containing aluminum as the main component. The metal containing aluminum as the main component represents a metal containing 50 mass % or more aluminum. It may also be pure aluminum. This metal contains aluminum in an amount of preferably 80 mass % or more, more preferably 90 mass % or more, and further preferably 94 mass % or more. The metal containing aluminum as the main component may be pure aluminum and, according to necessity, may contain another optional metal that can form an alloy with aluminum and may contain two kinds or more. The kind of metal is not particularly limited, but at least one kind of metal selected from the group consisting of magnesium, titanium, and zirconium is cited as a preferable metal. Among them, magnesium has an advantage in being capable of improving the strength of an aluminum base body and thus is particularly preferable.

Further, a metal oxide film of this invention is formed of an oxide of a metal containing, as the main component, high-purity aluminum with suppressed contents of specific elements (iron, copper, manganese, zinc, and chromium). The total content of the contents of these specific elements is preferably 1.0 mass % or less, more preferably 0.5 mass % or less, and further preferably 0.3 mass % or less. The metal containing high-purity aluminum as the main component may be pure aluminum and, according to necessity, may contain another optional metal that can form an alloy with aluminum and may contain two kinds or more. The kind of metal is not particularly limited with the exception of the foregoing specific elements, but at least one kind of metal selected from the group consisting of magnesium, titanium, and zirconium is cited as a preferable metal. Among them, magnesium has an advantage in being capable of improving the strength of an aluminum base body and thus is particularly preferable. The concentration of magnesium is not particularly limited as long as it is within a range capable of forming an alloy with aluminum, but, in order to achieve sufficient improvement in strength, it is normally set to 0.5 mass % or more, preferably to 1.0 mass % or more, and more preferably to 1.5 mass % or more. Further, in order to form a uniform solid solution with aluminum, it is preferably 6.5 mass % or less, more preferably 5.0 mass % or less, further preferably 4.5 mass % or less, and most preferably 3 mass % or less.

The metal containing aluminum as the main component or the metal containing high-purity aluminum as the main component according to this invention may contain, in addition thereto, another metal component as a crystal control agent. There is no particular limitation as long as it has a sufficient effect on crystal control, but zirconium or the like is preferably used.

In the case of containing these other metals, the content thereof is normally set to 0.01 mass % or more, preferably to 0.05 mass % or more, and more preferably to 0.1 mass % or more with respect to the entire metal containing aluminum as the main component or the entire metal containing high-purity aluminum as the main component. This is for allowing the characteristics by the other added metal to be sufficiently exhibited. However, it is normally set to 20 mass % or less, preferably to 10 mass % or less, more preferably to 6 mass % or less, particularly preferably to 4.5 mass % or less, and most preferably to 3 mass % or less. In order to allow aluminum and the other metal component to form a uniform solid solution to thereby maintain the excellent material properties, it is preferably less than the above.

According to another mode of this invention, there is obtained a metal member containing aluminum as the main component and having a passive aluminum oxide film on a surface brought into contact with at least one of a corrosive fluid, radicals, and irradiated ions, characterized in that the passive aluminum oxide film is a nonporous amorphous film having a thickness of 0.1 μm or more and 1 μm or less and a resistivity of 1E10 Ω·cm or more. The normal alumite cannot have a resistivity of 1E10 Ω·cm or more, while, the passive aluminum oxide film of this invention can achieve a thickness of 0.1 μm or more and 1 μm or less and a resistivity of 1E10 Ω·cm or more, preferably 1E11 to 1E14 Ω·cm, and more preferably 1E12 Ω·cm. Further, the passive aluminum oxide film is characterized in that its water release amount is 1E18 molecules/$cm^2$ or less.

The foregoing metal containing aluminum as the main component is characterized by containing 50 mass % or more aluminum and 1 to 4.5 mass % magnesium. If magnesium is contained, there is the effect of improving the mechanical strength and thus the metal becomes strong against heat and can withstand a heat treatment at 150° C. to 500° C. after anodic oxidation. However, if it is possible to omit the heat treatment by spending much time for the anodic oxidation to reduce the current value, it is not necessary to add magnesium. It is preferable that the foregoing metal containing aluminum as the main component contain zirconium in an amount of 0.15 mass % or less and preferably 0.1 mass % or less. This makes it possible to further increase the mechanical strength and heat resistance.

In the metal member of this invention, the total content of elements excluding aluminum, magnesium, and zirconium is preferably 1 mass % or less. Further, the content of each of the elements excluding aluminum, magnesium, and zirconium is preferably 0.01 mass % or less. If the contents of these impurity elements exceed the foregoing value, oxygen is produced in the oxide film so that voids are formed to cause occurrence of cracks in annealing. Further, there is caused an increase in residual current of the film.

It is preferable that the metal member of this invention be used particularly at a portion brought into contact with at least one of a corrosive fluid, radicals, and irradiated ions in each of various apparatuses used in manufacturing processes of electronic devices.

Next, a description will be given of a manufacturing method of the oxide film of the metal containing aluminum as the main component or the metal containing high-purity aluminum as the main component according to this invention.

According to a method of anodizing the metal containing aluminum as the main component or the metal containing high-purity aluminum as the main component in an anodization solution of pH 4 to 10, there is an advantage in that it is possible to obtain a dense pore-free barrier-type metal oxide film. Generally, by anodizing a base body made of the metal containing aluminum as the main component in the anodization solution of pH 4 to 10, a film made of an oxide of the metal containing aluminum as the main component is formed on the surface of the base body.

This method has a function of repairing a defect caused by nonuniformity of a substrate and thus has an advantage in enabling formation of a dense and smooth oxide film. The pH of the anodization solution used in this invention is normally 4 or more, preferably 5 or more, and more preferably 6 or more, while, is normally 10 or less, preferably 9 or less, and more preferably 8 or less. The pH is desirably close to neutral so that the metal oxide film formed by the anodic oxidation is not easily dissolved in the anodization solution.

The anodization solution used in this invention preferably exhibits a buffering action in the range of pH 4 to 10 in order also to maintain the pH within a predetermined range by buffering concentration changes of various substances during the anodization. In view of this, it is desirable to contain a compound such as an acid or a salt that exhibits the buffering action. The kind of such a compound is not particularly limited, but in terms of high solubility in the anodization solution and also high solution stability, it is preferably at least one kind selected from the group consisting of boric acid, phosphoric acid, organic carboxylic acid, and salts thereof. It is more preferably the organic carboxylic acid or its salt with almost no residual boron or phosphorus element in the metal oxide film.

This is because although a solute component even in a very small amount enters a metal oxide film formed by anodic oxidation, if use is made of the organic carboxylic acid or its salt as the solute, there is no possibility at all of dissolution of the boron or phosphorus element from the metal oxide film when it is applied to a vacuum thin-film forming apparatus or the like and, therefore, it is possible to expect the stability and improvement in quality of a formed thin film and in performance of a device or the like using it.

Any organic carboxylic acid may be used as long as it has one or two or more carboxyl groups. Further, as long as the expected effect of this invention is not marred, it may further have a functional group other than the carboxyl group. For example, formic acid or the like can be preferably used. In terms of high solubility in the anodization solution and also high solution stability, aliphatic carboxylic acid series are preferable and, among them, an aliphatic dicarboxylic acid with a carbon number of 3 to 10 is preferable. As the aliphatic dicarboxylic acid, there is no particular limitation, but there can be cited, for example, malonic acid, maleic acid, fumaric acid, succinic acid, tartaric acid, itaconic acid, glutaric acid, dimethylmalonic acid, citraconic acid, citric acid, adipic acid, heptane acid, pimelic acid, suberic acid, azelaic acid, sebacic acid, and so on. Among them, the tartaric acid, the citric acid, and the adipic acid are particularly preferable in terms of solution stability, safety, excellent buffering action, and so on. These acids may be used alone or in combination of two or more kinds.

The salt of boric acid, phosphoric acid, or organic carboxylic acid may be a salt of such an acid and a proper cation. As the cation, there is no particular limitation, but use can be made of, for example, an ammonium ion, a primary, secondary, tertiary, or quaternary alkylammonium ion, an alkali metal ion, a phosphonium ion, a sulfonium ion, or the like. Among them, the ammonium ion and the primary, secondary, tertiary, or quaternary alkylammonium ion are preferable in terms of less influence caused by remaining of metal ions due to diffusion thereof to a substrate metal caused by remaining thereof on the surface of the substrate metal. An alkyl group of the alkylammonium ion may be properly selected in consideration of solubility in the anodization solution, but is normally an alkyl group with a carbon number of 1 to 4.

These compounds may be used alone or in combination of two or more kinds. Further, the anodization solution according to this invention may contain another compound in addition to the foregoing compound.

The compound concentration may be properly selected depending on the purpose, but is normally set to 0.01 mass % or more, preferably to 0.1 mass % or more, and more preferably to 1 mass % or more with respect to the entire anodization solution. It is desirable to increase the concentration for increasing the electrical conductivity to sufficiently carry out the formation of the metal oxide film. However, the concentration is normally set to 30 mass % or less, preferably to 15 mass % or less, and more preferably to 10 mass % or less. In order to maintain high performance of the metal oxide film and to suppress the cost, it is desirably no greater than the above.

The anodization solution used in this invention preferably contains a nonaqueous solvent. If the anodization solution containing the nonaqueous solvent is used, the time required for constant-current anodization can be shortened as compared with an aqueous solution-based anodization solution and thus there is an advantage in enabling high-throughput processing.

The kind of nonaqueous solvent is not particularly limited as long as it enables excellent anodic oxidation and has a sufficient solubility with respect to the solute, but it is preferably a solvent having one or more alcoholic hydroxyl groups and/or one or more phenolic hydroxyl groups, or a non-protic organic solvent. Among them, the solvent having the alcoholic hydroxyl group/groups is preferable in view of the storage stability.

As the compound having the alcoholic hydroxyl group/groups, use can be made of, for example, monohydric alcohol such as methanol, ethanol, propanol, isopropanol, 1-butanol, 2-ethyl-1-hexanol, or cyclohexanol; dihydric alcohol such as ethylene glycol, propylene glycol, butane-1,4-diol, diethylene glycol, triethylene glycol, or tetraethylene glycol; polyhydric alcohol, i.e. tri- or higher-hydric alcohol, such as glycerin or pentaerythritol; or the like. Further, as long as the expected effect of this invention is not marred, use can be made of a solvent further having a functional group other than the alcoholic hydroxyl group in a molecule. Among them, in view of miscibility with water and vapor pressure, the compound having two or more alcoholic hydroxyl groups is preferable, the dihydric alcohol or the trihydric alcohol is more preferable, and the ethylene glycol, the propylene glycol, or the diethylene glycol is particularly preferable.

As the compound having the phenolic hydroxyl group/groups, use can be made of, for example, alkylphenol series such as non-substituted phenol, o-/m-/p-cresol series, or xylenol series having one hydroxyl group, resorcinol series having two hydroxyl groups, pyrogallol series having three hydroxyl groups, or the like.

As long as the expected effect of this invention is not marred, the compound having the alcoholic hydroxyl group/groups and/or the phenolic hydroxyl group/groups may further have another functional group in a molecule. For example, use can be made of a solvent, such as methylcellosolve or cellosolve, having an alcoholic hydroxyl group and an alkoxy group.

As the non-protic organic solvent, either a polar solvent or a nonpolar solvent may be used.

As the polar solvent, there is no particular limitation, but there can be cited, for example, cyclic carboxylate series such as γ-butyrolactone, γ-valerolactone, and δ-valerolactone; chain carboxylate series such as methyl acetate, ethyl acetate, and methyl propionate; cyclic carbonic acid ester series such as ethylene carbonate, propylene carbonate, butylene carbonate, and vinylene carbonate; chain carbonic acid ester series such as dimethyl carbonate, ethyl methyl carbonate, and diethyl carbonate; amide series such as N-methylformamide, N-ethylformamide, N,N-dimethylformamide, N,N-diethylformamide, N-methylacetamide, N,N-dimethylacetamide, and N-methylpyrrolidone; nitrile series such as acetonitrile, glutaronitrile, adiponitrile, methoxyacetonitrile, and 3-methoxypropionitrile; and phosphate series such as trimethyl phosphate and triethyl phosphate.

As the nonpolar solvent, there is no particular limitation, but there can be cited, for example, hexane, toluene, silicon oil, and so on.

These solvents may be used alone or in combination of two or more kinds. The ethylene glycol, the propylene glycol, or the diethylene glycol is particularly preferable as the nonaqueous solvent of the anodization solution used in forming the metal oxide film of this invention and these solvents may be used alone or in combination thereof. If the nonaqueous solvent is contained, water may be contained.

With respect to the entire anodization solution, the nonaqueous solvent is contained in an amount of normally 10 mass % or more, preferably 30 mass % or more, further preferably 50 mass % or more, and particularly preferably 55 mass % or more, while, is contained in an amount of normally 95 mass % or less, preferably 90 mass % or less, and particularly preferably 85 mass % or less.

If the anodization solution contains water in addition to the nonaqueous solvent, the content thereof with respect to the entire anodization solution is normally 1 mass % or more, preferably 5 mass % or more, further preferably 10 mass % or more, and particularly preferably 15 mass % or more, while, is normally 85 mass % or less, preferably 50 mass % or less, and particularly preferably 40 mass % or less.

The ratio of the water to the nonaqueous solvent is normally 1 mass % or more, preferably 5 mass % or more, further preferably 7 mass % or more, and particularly preferably 10 mass % or more, while, is normally 90 mass % or less, preferably 60 mass % or less, further preferably 50 mass % or less, and particularly preferably 40 mass % or less.

The anodization solution according to this invention may contain another additive according to necessity. For example, it may contain an additive for improving the formability and properties of the metal oxide film. As the additive, there is no particular limitation as long as the expected effect of this invention is not significantly marred, and use can be made of one or more kinds of substances selected from additives used in known anodization solutions and other substances. In this event, the adding amount of the additive is not particularly limited and may be set to a proper value in consideration of its effect and cost, and so on.

In this invention, there is no particular limitation to an electrolytic method for anodic oxidation as long as the expected effect of this invention is not significantly marred. As a current waveform, use can be made of, for example, other than a direct current, a pulse method in which the applied voltage is periodically intermittent, a PR method in which the polarity is reversed, an alternating current, AC- DC superimposition, incomplete rectification, a modulation current such as a triangular wave, or the like, but preferably, the direct current is used.

In this invention, there is no particular limitation to a method of controlling current and voltage of the anodic oxidation and it is possible to properly combine the conditions for forming the oxide film on the surface of the metal containing aluminum as the main component. Normally, it is preferable to carry out anodic oxidation at a constant current and at a constant voltage. That is, it is preferable that anodization be carried out at a constant current until reaching a predetermined anodization voltage Vf and, after the anodization voltage is reached, anodic oxidation be carried out while maintaining the voltage for a fixed time.

In this event, in order to efficiently form an oxide film, the current density is normally set to 0.001 $mA/cm^2$ or more, and preferably to 0.01 $mA/cm^2$ or more. However, in order to obtain an oxide film with excellent surface flatness, the current density is normally set to 100 $mA/cm^2$ or less, and preferably to 10 $mA/cm^2$ or less.

Further, the anodization voltage Vf is normally set to 3V or more, preferably to 10V or more, and more preferably to 20V or more. Since the thickness of the oxide film to be obtained is related to the anodization voltage Vf, it is preferable to apply the voltage no less than the above in order to give a certain thickness to the oxide film. However, it is normally set to 1000V or less, preferably to 700V or less, and more preferably to 500V or less. Since the oxide film to be obtained is highly insulative, it is preferable to perform the anodic oxidation at the voltage no greater than the above in order to form the good-quality oxide film without causing dielectric breakdown at high voltage.

Use may be made of a method of using an alternating current with a constant peak current value until reaching an anodization voltage instead of a DC power supply, then switching to a DC voltage when the anodization voltage is reached, and holding it for a fixed time.

In this invention, the other conditions of the anodic oxidation are not particularly limited. However, the temperature during the anodic oxidation is set to fall within a temperature range where the anodization solution exists in the form of a stable liquid. It is normally −20° C. or more, preferably 5° C. or more, and more preferably 10° C. or more. In consideration of the production/energy efficiency and so on in the manufacture, it is preferable to perform the processing at the temperature no less than the above. However, it is normally 150° C. or less, preferably 100° C. or less, and more preferably 80° C. or less. In order to hold the composition of the anodization solution to carry out uniform anodic oxidation, it is preferable to perform the processing at the temperature no higher than the above.

According to the manufacturing method of this invention, since the dense pore-free barrier-type metal oxide film can be efficiently manufactured by the anodic oxidation method, there is an advantage in that the withstand voltage is high and it is possible to suppress occurrence of fractures, cracks or the like in the annealing and thus to reduce the outgas release amount from the film. Since the withstand voltage of the film is high, it is suitable as a protective coating film for the surface of a metal base member, such as a film for protecting a structural member such as an inner wall of a vacuum thin-film forming apparatus. Further, this metal oxide film can also serve as an impurity shielding coating film or an anticorrosive coating film, other than the protective coating film for the surface of the metal base member.

According to still another mode of this invention, there is obtained a metal member manufacturing method characterized by anodizing a metal member containing aluminum as the main component in an anodization solution containing an organic solvent having a dielectric constant smaller than that of water and capable of dissolving water, thereby forming a nonporous amorphous passive aluminum oxide film. The dielectric constant of water is about 80. Since the binding energy of matter is inversely proportional to the square of the dielectric constant, water is dissociated even at 0° C. in an HF solution having a higher dielectric constant of, for example, 83. Therefore, in order to prevent decomposition of water to thereby prevent etching of a grown aluminum oxide film, anodic oxidation should be performed in an anodization solution containing an organic solvent with a low vapor pressure having a dielectric constant smaller than that of water and capable of dissolving water. As a result, it is possible to form a nonporous amorphous passive aluminum oxide film. As examples of such an organic solvent, ethylene glycol has a dielectric constant of 39, diethylene glycol a dielectric constant of 33, triethylene glycol of 24, and tetraethylene glycol of 20. Accordingly, if any of these organic solvents is used, it is possible to effectively reduce the dielectric constant and thus to apply a high voltage without causing electrolysis of water. For example, if the ethylene glycol is used, it is possible to apply an anodization voltage up to a maximum of 200V without causing electrolysis of water, thereby forming a passive aluminum oxide film in the form of a nonporous amorphous film having a thickness of 0.3 μm. If the diethylene glycol is used, it is possible to apply an anodization voltage up to a maximum of 300V without causing electrolysis of water, thereby forming a passive aluminum oxide film in the form of a nonporous amorphous film having a thickness of 0.4 μm.

The anodization solution is added with an electrolyte that makes the anodization solution electrically conductive, but if the anodization solution becomes acid as a result of it, the aluminum member is corroded. Therefore, use is made of an electrolyte, for example, adipate, that causes the anodization solution to have a pH of 4 to 10, preferably 5.5 to 8.5, and more preferably 6 to 8 while increasing the electrical conductivity thereof, and thus can prevent corrosion of aluminum. The content thereof is 0.1 to 10 mass % and preferably about 1%. In a typical example, use is made of an anodization solution containing 79% organic solvent, 20% water, and 1% electrolyte.

The anodic oxidation preferably includes a first step of placing the metal member and a counter electrode (e.g. platinum) in the anodization solution, a second step of applying a plus to the metal member and a minus to the electrode to cause a constant current to flow for a predetermined time, and a third step of applying a constant voltage between the metal member and the electrode for a predetermined time. The predetermined time in the second step is preferably a time required for a voltage between the metal member and the electrode to reach a predetermined value (e.g. 200V when ethylene glycol is used).

The predetermined time in the third step is preferably a time required for a current between the metal member and the electrode to reach a predetermined value. The current value rapidly decreases when the voltage reaches the foregoing predetermined value, and then gradually decreases with time. As this residual current becomes smaller, the quality of the oxide film is improved. For example, if the constant-voltage processing is carried out for 24 hours, the film quality becomes equivalent to that obtained through a heat treatment. In order to increase the productivity, it is necessary to finish the constant-voltage processing in a proper time and carry out a heat treatment (annealing). The heat treatment is preferably carried out at about 150° C. to 300° C. for 0.5 to 1 hour.

In the second step, a current of 0.01 to 100 mA, preferably 0.1 to 10 mA, and more preferably 0.5 to 2 mA is caused to flow per square centimeter.

As described above, in the third step, the voltage is set to a value that does not cause electrolysis of the anodization solution. The thickness of the nonporous amorphous passive aluminum oxide film depends on the voltage in the third step.

Although not adhering to any theories, it is considered that the foregoing excellent effects of this invention depend on the fact that the pore-free metal oxide film formed in the anodization has the amorphous structure in its entirety and thus there are almost no crystal grain boundaries or the like. It is presumed that, by further adding the compound having the buffering action and using the nonaqueous solvent as the solvent, carbon components in very small quantities are trapped into the metal oxide film to weaken the Al—O binding strength, so that the amorphous structure of the entire film is stabilized.

The metal oxide film thus manufactured may be heat-treated for the purpose of removing water in the film, or the like. The conventional metal oxide film having the porous structure may be subjected to occurrence of fractures or cracks even in annealing at about 150 to 200° C. and thus cannot be heat-treated at high temperature so that sufficient water removal cannot be carried out, thus resulting in the outgas release amount being able to be reduced. Since the metal oxide film according to this invention is the dense pore-free barrier-type film, there is an advantage in that it is possible to suppress occurrence of fractures, cracks, or the like in annealing and thus to reduce the outgas release amount from the film.

Particularly, a coating film of an oxide of a metal containing, as the main component, high-purity aluminum hardly containing the foregoing specific elements is higher in thermal stability as compared with a metal oxide coating film containing an aluminum alloy as the main component and is hardly subjected to formation of voids, gas pools, or the like. Therefore, voids or seams hardly occur in the metal oxide film even in annealing at about 300° C. or more and thus there is an advantage in that it is possible to suppress generation of particles and corrosion by chemicals or halogen gases, particularly a chlorine gas, due to exposure of the aluminum base body and the release of outgas from the film is smaller in amount.

A heat treatment method is not particularly limited, but annealing in a heating furnace or the like is simple and preferable.

The temperature of the heat treatment is not particularly limited as long as the expected effect of this invention is not marred, but it is normally 100° C. or more, preferably 200° C. or more, and more preferably 250° C. or more. In order to sufficiently remove water on the surface of and inside the metal oxide film by the heat treatment, it is preferable to perform the treatment at the temperature no less than the above. However, it is normally 600° C. or less, preferably 550° C. or less, and more preferably 500° C. or less. It is preferable to perform the treatment at the temperature no higher than the above in order to hold the amorphous structure of the metal oxide film and maintain the flatness of the surface. In the case of annealing, the set temperature of a heating furnace is normally regarded as a heat treatment temperature.

The time of the heat treatment is not particularly limited as long as the expected effect of this invention is not marred, and may be properly set in consideration of the intended effect, the surface roughness due to the heat treatment, the productivity, and so on. It is normally 1 minute or more, preferably 5 minutes or more, and particularly preferably 15 minutes or more. In order to sufficiently remove water on the surface of and inside the metal oxide film, it is preferable to perform the treatment for the time no less than the above. However, it is normally 180 minutes or less, preferably 120 minutes or less, and more preferably 60 minutes or less. It is preferable to perform the treatment for the time no more than the above in order to maintain the metal oxide film structure and the surface flatness.

A gas atmosphere in the furnace during the annealing is not particularly limited as long as the expected effect of this invention is not marred. Normally, nitrogen, oxygen, a mixed gas thereof, or the like can be used. Among them, an atmosphere with an oxygen concentration of 18 vol % or more is preferable, a condition of 20 vol % or more is more preferable, and a condition of an oxygen concentration of 100 vol % is most preferable.

Next, a description will be given of a laminate including a film formed of an oxide of a metal containing aluminum as the main component or a metal containing high-purity aluminum as the main component and of a use thereof.

A laminate formed with a metal oxide film of this invention as a protective film on a base body formed of a metal containing aluminum as the main component or a metal containing high-purity aluminum as the main component exhibits excellent corrosion resistance against chemicals and halogen gases particularly a chlorine gas. Further, since cracks hardly occur in the metal oxide film even when it is heated, it is possible to sufficiently remove water in the film by annealing or the like and thus to suppress release of outgas from the film. Normally, corrosion of aluminum by a chlorine gas requires three factors, i.e. an oxidizer, chlorine ions, and water, but since the chlorine gas itself is an oxidizer and can be a supply source of chlorine ions, if water is present, the corrosion is caused. However, since the water release amount as outgas from the metal oxide film of this invention is extremely small, it becomes possible to suppress the corrosion of aluminum. Further, it is possible to suppress generation of particles due to cracks and corrosion due to exposure of the aluminum base body at crack portions.

According to necessity, another layer may be provided on the upper or lower side of the metal oxide film of this invention. Since the metal oxide film of this invention is as thin as 1 μm or less, it is preferable to provide a laminated film structure with two or more layers in order to reinforce the physical and mechanical strength.

For example, a thin film using one kind or two or more kinds selected from a metal, a cermet, and a ceramic as a material thereof may be further formed on the metal oxide film, thereby obtaining a multilayer structure. As the metal, there is cited one kind of metal alone or an alloy of two or more kinds of elements. Although the kind is not particularly limited, transition metal series are preferably used in consideration of strength, corrosion resistance, and so on.

As a method of forming a metal, cermet, or ceramic film, an optional method can be used as long as the expected effect of this invention is not marred, but use is preferably made of a spraying method that is high in film forming rate and capable of forming a thick coating film and has a high degree of freedom for the kind, shape, and size of a material to be sprayed.

As described above, the metal oxide film according to this invention is strong against gases such as a chlorine gas and chemicals, wherein cracks or the like due to heating hardly occur and further the outgas is small in amount, and therefore, it is highly suitable as a coating film for protecting a structural member of a semiconductor or flat panel display manufacturing apparatus. Further, the laminate having this metal oxide film on the base body made of the aluminum-based metal is suitable as a structural member of a semiconductor or flat panel display manufacturing apparatus. Herein the semiconductor or flat panel display manufacturing apparatus represents a manufacturing apparatus for use in the semiconductor or flat panel display manufacturing field or the like, i.e. a vacuum thin-film forming apparatus for use in chemical vapor deposition (CVD), physical vapor deposition (PVD), vacuum deposition, sputtering, microwave-excited plasma CVD, or the like, or a dry etching apparatus for use in plasma etching, reactive ion etching (RIE), recently-developed microwave-excited plasma etching, or the like.

EXAMPLES

This invention will be concretely described using Examples and Comparative Examples, but this invention is not limited thereto as long as not exceeding the gist of the invention.

In Examples 1 to 10 of this application, use was made of a JIS A5052 material as aluminum, special grade reagents produced by Wako Pure Chemical Industries, Ltd. as tartaric acid and ethylene glycol, special grade reagents produced by Kanto Chemical Co., Inc. as adipic acid, boric acid, sodium borate, phosphoric acid, sodium phosphate, and oxalic acid, and EL-grade chemicals produced by Mitsubishi Chemical Corporation as sulfuric acid and aqueous ammonia.

Anodic oxidation was performed using a source meter (2400 series produced by KEITHLEY), wherein a pure platinum plate was used as a cathode and the temperature of an anodization solution was adjusted to 23° C. After the anodic oxidation, annealing was performed at a predetermined temperature for 1 hour while causing a gas with a composition of nitrogen/oxygen=80/20 (vol ratio) to flow at a flow rate of 5 L/min in a quartz tube infrared heating furnace (hereinafter abbreviated as an "IR furnace").

The thickness of an anodized film was measured by a transmission electron microscope and a scanning electron microscope (JSM-6700 produced by JEOL Ltd.). The presence of cracks was observed by visual observation and either of a digital microscope (VHX-200 produced by Keyence Corporation) and a scanning electron microscope.

The water release amount from the surface of an anodized film was measured using an atmospheric pressure ionization mass spectrometry apparatus (UG-302P produced by Renesas Eastern Japan) (hereinafter abbreviated as "APIMS Analysis Apparatus"). After placing a sample in a SUS316-made reactor tube kept at 23° C., an argon gas was caused to flow at a flow rate of 1.2 L/min. The argon gas having passed through the reactor tube was introduced into the APIMS where mass numbers associated with water (18 ($H_2O^+$), 19($(H_2O)H^+$), 37($(H_2O)_2H^+$), 55($(H_2O)_3H^+$)) detected in the argon gas were measured for deriving a water release amount per unit area (the number of released water molecules [molecules/$cm^2$]) released from the sample.

The argon gas was discharged from the line for first 3 minutes after the argon gas started to flow, and the measurement was performed thereafter. When measuring a sample of each Example, after the lapse of 10 hours at 23° C., the temperature of the reactor tube started to be raised and, after reaching 200° C. (after 3 hours), was maintained at 200° C. for 2 hours, and the measurement was performed over this entire period. On the other hand, it was expected that since the water release amount of a sample of each Comparative Example was large, if measured in the same manner as in each Example, the measurable range of the water measuring apparatus would be exceeded. Accordingly, when measuring the sample of each Comparative Example, because of water release being large, 23° C. was maintained even after the lapse of 10 hours and the measurement was performed for the same time (15 hours in total) as that in each Example.

The resistance of a metal oxide film against a chlorine gas was measured in the following manner. That is, after placing a sample in a SUS316-made reactor tube, the temperature of the reactor tube was raised to 200° C. while causing a nitrogen gas to flow at a flow rate of 1 L/min. After reaching 200° C., the temperature was maintained for 5 hours to carry out prebake. After lowering the temperature of the reactor tube to 100° C. in this state, the gas was switched to a chlorine gas. After the inside of the reactor tube was completely replaced by the chlorine gas, the chlorine gas of 0.3 MPa was enclosed in the reactor tube at 100° C. and kept for 6 hours. After exposure to the chlorine gas, the inside of the reactor tube was replaced by a nitrogen gas. The surface properties of the sample after the exposure to the chlorine gas were observed by visual observation and the scanning electron microscope.

Anodization solutions used in Examples and Comparative Examples were prepared with the compositions shown in Table 1.

TABLE 1

| Kind of | Solute | | | Water | |
|---|---|---|---|---|---|
| Anodization Solution | Kind | Content (wt %) | Main Solvent | Content (wt %) | pH |
| a | ammonium tartrate | 1 | ethylene glycol | 19 | 7.1 |
| b | ammonium adipate | 1 | ethylene glycol | 19 | 7.0 |
| c | ammonium adipate | 1 | water | 99 | 7.0 |
| d | boric acid + sodium borate | 3 | water | 97 | 7.1 |
| e | phosphoric acid + sodium phosphate | 3 | water | 97 | 7.2 |
| f | sulfuric acid | 10 | water | 90 | <1 |
| b | oxalic acid | 4 | water | 96 | <1 |

Example 1

1.8 g of tartaric acid was dissolved into 39.5 g of water, then 158 g of ethylene glycol (EG) was added, and then stirring/mixing was carried out. While stirring this solution, 29% aqueous ammonia was added until the pH of the solution reached 7.1, thereby preparing an anodization solution a. In this anodization solution, an A5052 aluminum sample piece of 20×8×1 mm was anodized at a constant current of 1 mA/$cm^2$ until reaching an anodization voltage of 50V and, after 50V was reached, the sample piece was anodized at the constant voltage for 30 minutes. After the reaction, it was sufficiently washed with pure water and then dried at room temperature. The obtained aluminum sample piece with an oxide film was annealed at 300° C. for 1 hour in the IR furnace and then opened to the atmosphere so as to be left standing at room temperature for 48 hours. The thickness of the barrier-type metal oxide film was measured to be 0.08 μm. No cracks were observed. The water release amount was measured to be 2E16 molecules/cm$^2$ or less. The results are collectively shown in Table 2.

TABLE 2

| | Kind of Anodization Solution | Current Density Jcc (mA/cm$^2$) | Voltage Vf (V) | Annealing Condition | Anodized Film Thickness (μm) | Crack | Water Release Amount (molecules/cm$^2$) |
|---|---|---|---|---|---|---|---|
| Example 1 | a | 1 | 50 | 300° C. 1 h | 0.08 | no | <2E16 |
| Example 2 | a | 1 | 100 | 300° C. 1 h | 0.15 | no | <2E16 |
| Example 3 | a | 1 | 200 | 300° C. 1 h | 0.30 | no | <2E16 |
| Example 4 | b | 1 | 200 | 300° C. 1 h | 0.31 | no | <2E16 |
| Example 5 | c | 1 | 200 | 300° C. 1 h | 0.29 | no | <2E16 |
| Example 6 | d | 1 | 200 | 300° C. 1 h | 0.29 | no | <2E16 |
| Example 7 | e | 1 | 200 | 300° C. 1 h | 0.28 | no | <2E16 |
| Comparative Example 1 | f | 10 | 20 | 200° C. 1 h | 35 | yes | >1E19 |
| Comparative Example 2 | f | 10 | 20 | 200° C. 1 h | 40 | yes | >1E19 |
| Comparative Example 3 | g | 10 | 40 | 300° C. 1 h | 13 | yes | >7E18 |

Example 2

An oxide film was formed in the same manner as in Example 1 except that the anodization voltage was set to 100V. The thickness of the barrier-type metal oxide film was measured to be 0.15 μm. No cracks were observed. The water release amount was measured to be 2E16 molecules/cm$^2$ or less.

Example 3

An oxide film was formed in the same manner as in Example 1 except that the anodization voltage was set to 200V. The thickness of the barrier-type metal oxide film was measured to be 0.30 μm. No cracks were observed. The water release amount was measured to be 2E16 molecules/cm$^2$ or less.

Example 4

1.8 g of adipic acid was dissolved into 39.5 g of water, then 158 g of ethylene glycol was added, and then stirring/mixing was carried out. An oxide film was formed in the same manner as in Example 3 except that, while stirring this solution, 29% aqueous ammonia was added until the pH of the solution reached 7.0, thereby preparing an anodization solution b. The thickness of the barrier-type metal oxide film was measured to be 0.31 μm. No cracks were observed. The water release amount was measured to be 2E16 molecules/cm$^2$ or less.

Example 5

1.8 g of adipic acid was added to 197.5 g of water and stirring/mixing was carried out. While stirring this solution, 29% aqueous ammonia was added until the pH of the solution reached 7.0, thereby preparing an anodization solution c. In this anodization solution, an A5052 aluminum sample piece of 20×8×1 mm was anodized at a constant current of 1 mA/cm$^2$ until reaching an anodization voltage of 200V and, after 200V was reached, the sample piece was anodized at the constant voltage for 30 minutes. After the reaction, it was sufficiently washed with pure water and then dried at room temperature. The obtained aluminum sample piece with an oxide film was annealed at 300° C. for 1 hour in the IR furnace and then opened to the atmosphere so as to be left standing at room temperature for 48 hours. The thickness of the barrier-type metal oxide film was measured to be 0.29 μm. No cracks were observed. The water release amount was measured to be 2E16 molecules/cm$^2$ or less.

FIG. 1 shows voltage changes with the lapse of time during the anodic oxidation in Examples 4 and 5. It is seen that, in Example 4 using a nonaqueous solvent as a main solvent of the anodization solution, the predetermined voltage was reached in a shorter time and thus the metal oxide film can be formed at high throughput.

Example 6

4.5 g of boric acid and 1.5 g of sodium borate were added to 194 g of water and stirring/mixing was carried out. The pH of this solution was measured to be 7.1. In this anodization solution d, an A5052 aluminum sample piece of 20×8×1 mm was anodized at a constant current of 1 mA/cm$^2$ until reaching an anodization voltage of 200V and, after 200V was reached, the sample piece was anodized at the constant voltage for 30 minutes. After the reaction, it was sufficiently washed with pure water and then dried at room temperature. The obtained aluminum sample piece with an oxide film was annealed at 300° C. for 1 hour in the IR furnace and then opened to the atmosphere so as to be left standing at room temperature for 48 hours. The thickness of the barrier-type metal oxide film was measured to be 0.29 μm. No cracks were observed. The water release amount was measured to be 2E16 molecules/cm$^2$ or less.

Example 7

2.5 g of phosphoric acid and 3.5 g of sodium phosphate were added to 194 g of water and stirring/mixing was carried out. The pH of this solution was measured to be 7.2. In this anodization solution e, an A5052 aluminum sample piece of 20×8×1 mm was anodized at a constant current of 1 mA/cm$^2$ until reaching an anodization voltage of 200V and, after 200V was reached, the sample piece was anodized at the constant voltage for 30 minutes. After the reaction, it was sufficiently washed with pure water and then dried at room temperature. The obtained aluminum sample piece with an anodized film was annealed at 300° C. for 1 hour in the IR furnace and then opened to the atmosphere so as to be left standing at room temperature for 48 hours. The thickness of the anodized film was measured to be 0.28 μm. No cracks were observed. The water release amount was measured to be 2E16 molecules/$cm^2$ or less.

Comparative Example 1

20 g of 98% sulfuric acid was added to 180 g of water and stirring/mixing was carried out, thereby preparing an anodization solution f. In this anodization solution maintained at 20° C., an A5052 aluminum sample piece of 20×8×1 mm was subjected to electrolytic oxidation at a current density of 10 mA/$cm^2$ and a voltage of 20V for 2 hours. After the reaction, it was sufficiently washed with pure water and then dried at room temperature.

The thickness of an obtained electrolytic oxide coating film was measured to be about 35 μm and there were a number of fine holes on the surface of the film, i.e. a porous oxide film having a porous structure was formed. This porous oxide film was subjected to sealing in pressurized steam at 3 atm for 30 minutes. The aluminum sample piece with this oxide film was annealed at 200° C. for 1 hour in the IR furnace, then cracks occurred in the oxide film. After it was opened to the atmosphere so as to be left standing at room temperature for 48 hours, the water release amount was measured to be 1E19 molecules/$cm^2$ or more. It can be presumed that if the water release amount was measured under the same conditions as those in each Example, a still larger value was resulted.

Figure 2:
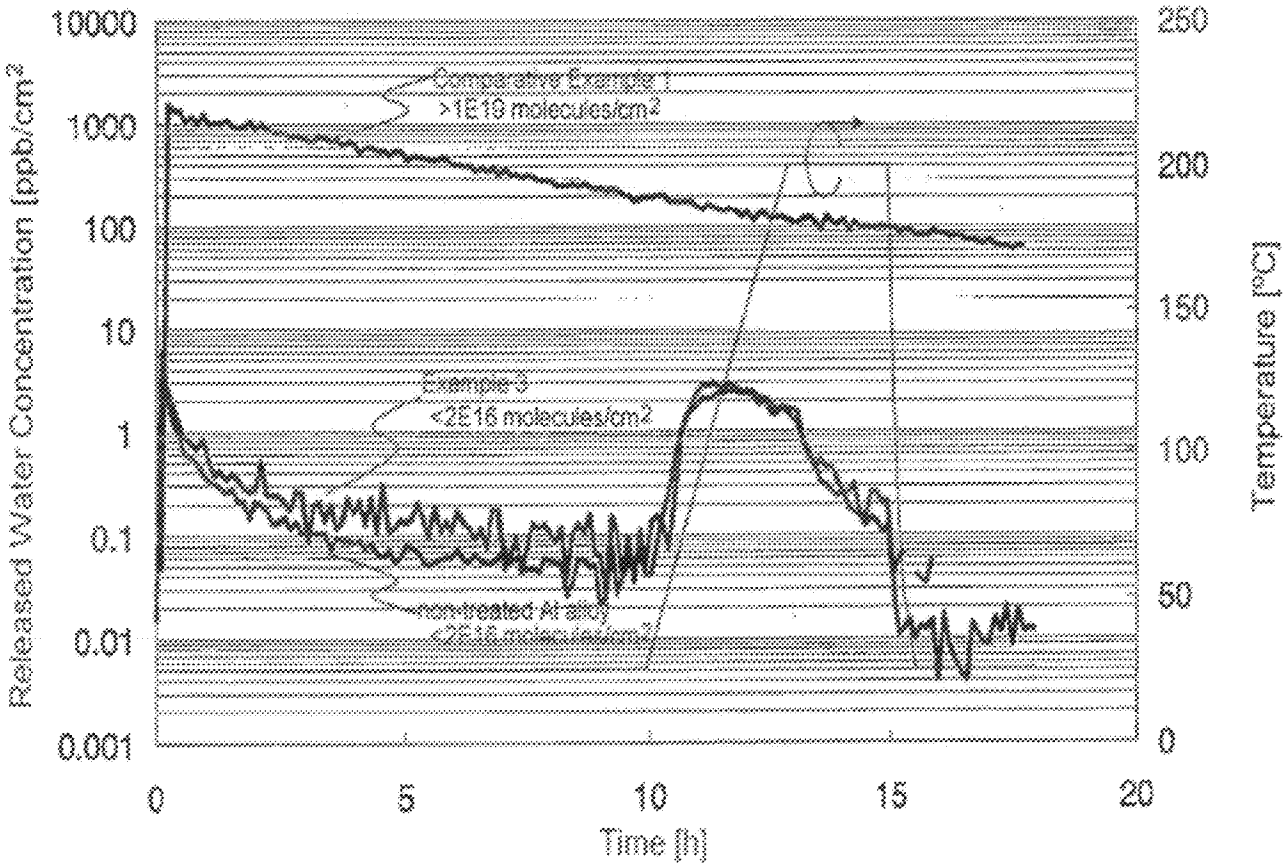
FIG. 2 is a graph showing the water release characteristics of samples of Example 3 and Comparative Example 1 and a non-treated aluminum sample piece.

FIG. 2 shows the measurement results of the water release characteristics of the samples of Example 3 and Comparative Example 1 and a non-treated aluminum sample piece. In Example 3, there were shown the water release characteristics substantially equivalent to those of the non-treated aluminum alloy, while, far more released water was observed in Comparative Example 1.

Comparative Example 2

The same processing was performed as in Comparative Example 1 except that electrolytic oxidation was carried out for 3 hours. The thickness of an electrolytic oxide coating film was measured to be about 40 μm. The aluminum sample piece with this oxide film was annealed at 200° C. for 1 hour in the IR furnace, then cracks occurred in the oxide film. The water release amount was measured to be 1E19 molecules/$cm^2$ or more. It can be presumed that if the water release amount was measured under the same conditions as those in each Example, a still larger value was resulted.

Comparative Example 3

8 g of oxalic acid was added to 192 g of water and stirring/mixing was carried out, thereby preparing an anodization solution g. In this anodization solution maintained at 30° C., an A5052 aluminum sample piece of 20×8×1 mm was subjected to electrolytic oxidation at a current density of 10 mA/$cm^2$ and a voltage of 40V for 1 hour. After the reaction, it was sufficiently washed with pure water and then dried at room temperature.

The thickness of an obtained electrolytic oxide coating film was measured to be about 13 μm and there were a number of fine holes on the surface of the film, i.e. a porous oxide film having a porous structure was formed. This porous oxide film was subjected to sealing in pressurized steam at 3 atm for 30 minutes. The aluminum sample piece with this oxide film was annealed at 300° C. for 1 hour in the IR furnace, then cracks occurred in the porous oxide film. After it was opened to the atmosphere so as to be left standing at room temperature for 48 hours, the water release amount was measured to be 7E18 molecules/$cm^2$ or more. It can be presumed that if the water release amount was measured under the same conditions as those in each Example, a still larger value was resulted.

Figure 3:
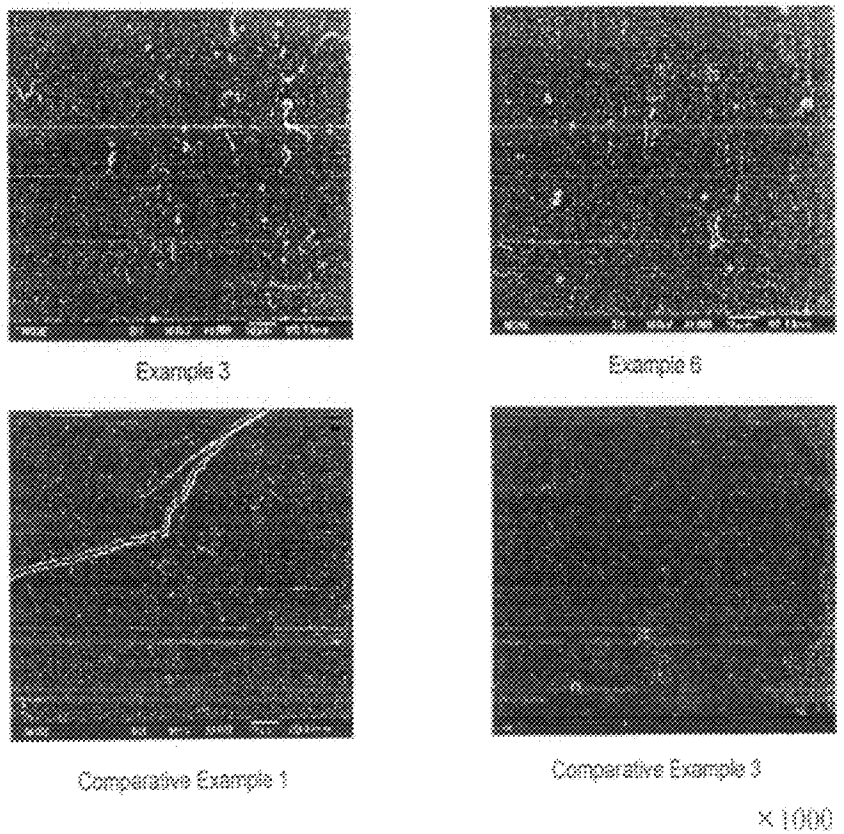
FIG. 3 is electron microscope photographs of the surfaces of samples after annealing in Examples 3 and 6 and Comparative Examples 1 and 3.

FIG. 3 shows the surface states by electron microscopic observation after the annealing in Examples 3 and 6 and Comparative Examples 1 and 3. It is seen that no cracks occurred even after the annealing in Examples 3 and 6, while, fine cracks occurred in Comparative Examples 1 and 3.

Examples 8 to 10

Oxide film-coated aluminum sample pieces obtained by the same processing as in Examples 3, 4, and 6 were subjected to chlorine-gas exposure resistance evaluation according to the foregoing method. The results are shown in Table 3.

TABLE 3

| | Kind of Anodization Solution | Current Density Jcc (mA/$cm^2$) | Voltage Vf (V) | Annealing Condition | Chlorine Gas Resistance |
|---|---|---|---|---|---|
| Example 8 | a | 1 | 200 | 300° C. 1 h | ○ |
| Example 9 | b | 1 | 200 | 300° C. 1 h | ○ |
| Example 10 | d | 1 | 200 | 300° C. 1 h | ○ |
| Comparative Example 4 | f | 10 | 20 | 150° C. 1 h | x |
| Comparative Example 5 | f | 10 | 20 | 150° C. 1 h | x |
| Comparative Example 6 | g | 10 | 40 | 150° C. 1 h | x |

○ No Corrosion
x Corroded

No corrosion was observed by visual observation with respect to any of the oxide film-coated aluminum sample pieces.

Comparative Examples 4 to 6

Figure 4:
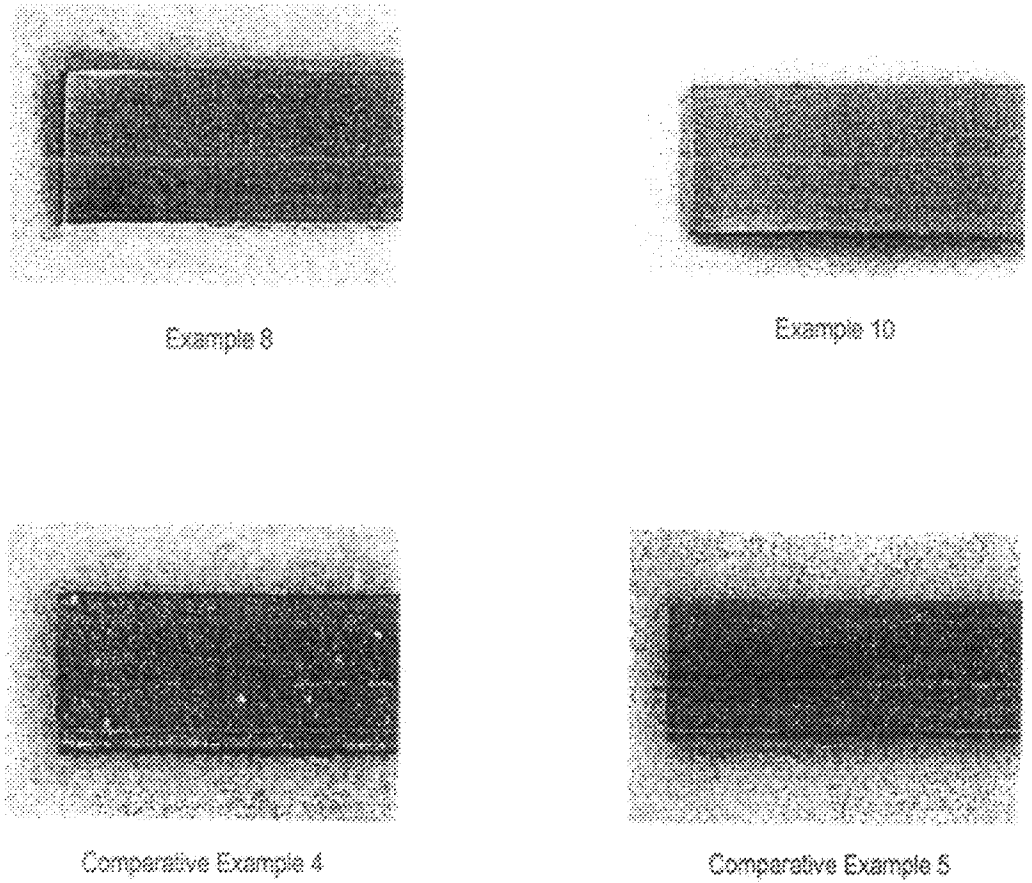
FIG. 4 is electron microscope photographs of the surfaces of samples after chlorine-gas exposure evaluation in Examples 8 and 10 and Comparative Examples 4 and 5.
Figure 5:
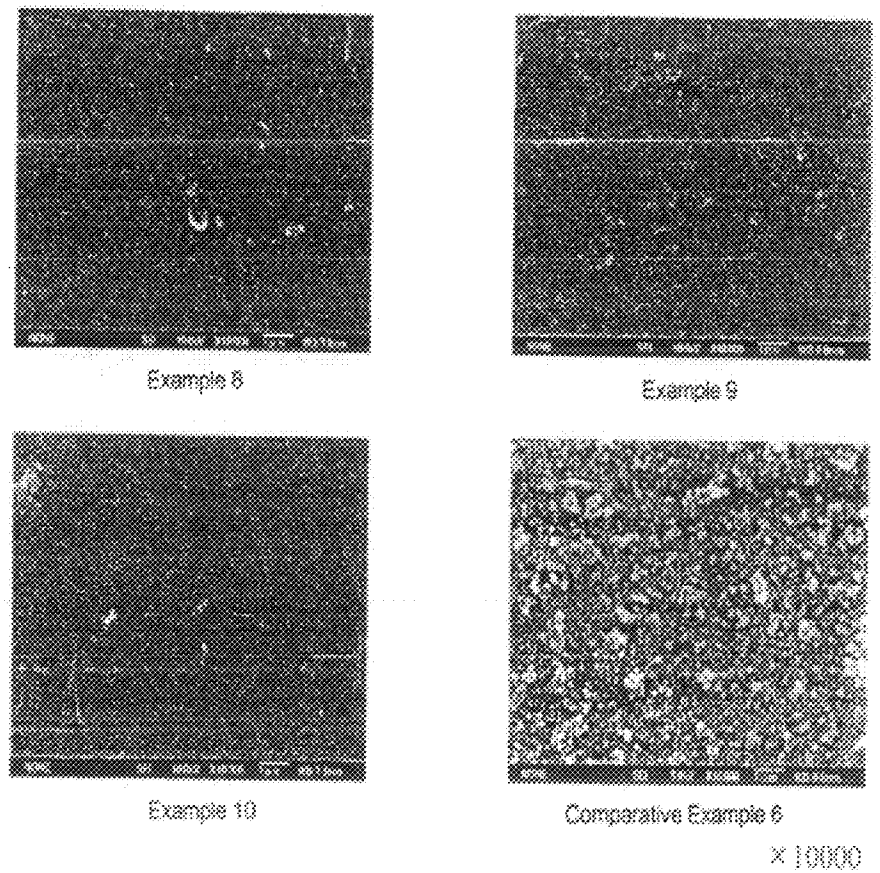
FIG. 5 is electron microscope photographs of the surfaces of samples after chlorine-gas exposure evaluation in Examples 8 to 10 and Comparative Example 6.

Chlorine-gas exposure resistance evaluation was performed in the same manner as in Examples 8 to 10 with respect to electrolytic oxide film-coated aluminum sample pieces obtained by the same processing as in Comparative Examples 1 to 3 except that the annealing conditions were changed. The results are shown in Table 3. FIG. 4 shows the aluminum surface states by visual observation after the chlorine-gas exposure evaluation in Examples 8 and 10 and Comparative Examples 4 and 5. No corrosion was observed in Examples 8 and 10, while, white pitting corrosion assumed to be aluminum chloride was observed in Comparative Example 4 and partial change of color of the sample piece was observed in Comparative Example 5. Further, FIG. 5 shows the aluminum surface states by electron microscopic observation after the chlorine-gas exposure evaluation in Examples 8 to 10 and Comparative Example 6. In Examples 8 to 10, almost no change was observed even after the exposure to the chlorine gas, while, in Comparative Example 6, a number of fine-grain adherends were observed on the surface and, further, a number of fine cracks occurred.

Next, Examples using high-purity aluminum will be described along with Comparative Examples.

In Examples 11 to 34, use was made, as aluminum, of a JIS A5052 material, 5N high-purity pure aluminum material (HQ0), and high-purity aluminum materials (HQ2 and HQ4.5) produced by Nippon Light Metal Co., Ltd., in which zirconium was added in an amount of 0.1 mass % to an aluminum-magnesium alloy in which the content of specific elements (iron, copper, manganese, zinc, and chromium) was suppressed to 0.03 mass % or less. Use was made of special grade reagents produced by Wako Pure Chemical Industries, Ltd. as tartaric acid and ethylene glycol, special grade reagents produced by Kanto Chemical Co., Inc. as adipic acid, boric acid, and sodium borate, and an EL-grade chemical produced by Mitsubishi Chemical Corporation as aqueous ammonia.

Anodization solutions used in Examples and Comparative Examples were prepared with the compositions shown in Table 1. Further, Table 4 shows the contents of the specific elements of the used aluminum and aluminum alloys.

TABLE 4

| | Mg | Zr | Content of Specific Element (wt %) | | | | | |
|---|---|---|---|---|---|---|---|---|
| Al Material | Concentration (mass %) | Concentration (mass %) | iron | copper | manganese | zinc | chromium | Total Content |
| HQ0 | 0 | 0.0 | 0.004 | <0.001 | <0.001 | <0.001 | <0.001 | 0.004 |
| HQ2 | 2 | 0.1 | 0.005 | <0.001 | <0.001 | <0.001 | <0.001 | 0.005 |
| HQ4.5 | 4.5 | 0.1 | 0.005 | <0.001 | <0.001 | <0.001 | <0.001 | 0.005 |
| A5052 | 2.5 | 0.0 | 0.4 | 0.1 | 0.1 | 0.1 | 0.4 | 1.1 |

Anodic oxidation was performed using a source meter (2400 series produced by KEITHLEY), wherein a pure platinum plate was used as a cathode and the temperature of an anodization solution was adjusted to 23° C. The reaction was initially carried out at a constant current until reaching a predetermined voltage and, after the voltage was reached, the reaction was carried out at the constant voltage, wherein the current density finally reached was given as a residual current density. According to necessity, after the anodic oxidation, annealing was performed at a predetermined temperature for 1 hour while causing a gas with a composition of nitrogen/oxygen=80/20 (vol ratio) to flow at a flow rate of 5 L/min in a quartz tube infrared heating furnace (hereinafter abbreviated as an "IR furnace").

A metal oxide film was subjected to surface observation using a scanning electron microscope (JSM-6700 produced by JEOL Ltd.).

Further, the etching amount of a metal oxide film with respect to a chemical solution was calculated in the following manner.

That is, after a chemical solution of a predetermined concentration was prepared in a polyethylene beaker, a sample was immersed therein at room temperature for 10 minutes. After the chemical-solution treatment, it was rinsed with ultrapure water and then blow-dried with a nitrogen gas. This sample was reanodized using an anodization solution a of Table 1 at a current density of 0.1 mA/cm$^2$ and the etching amount was converted from the amount of coulomb required for a voltage to reach 200V.

Further, the resistance of a metal oxide film against a chlorine gas was measured in the following manner. That is, after placing a sample in a SUS316-made reactor tube, the temperature of the reactor tube was raised to 200° C. while causing a nitrogen gas to flow at a flow rate of 1 L/min. After reaching 200° C., the temperature was maintained for 5 hours to carry out prebake. While maintaining the temperature of the reactor tube at 200° C. in this state, the gas was switched to a chlorine gas. After the inside of the reactor tube was completely replaced by the chlorine gas, the chlorine gas of 0.3 MPa was enclosed in the reactor tube at 200° C. and kept for 6 hours. After exposure to the chlorine gas, the inside of the reactor tube was replaced by a nitrogen gas. By weighing the weight of the sample before and after the exposure to the chlorine gas using a precision electron balance, the resistance of the metal oxide coating film was evaluated based on a reduction in weight.

The water release amount from the surface of a metal oxide film was measured using an atmospheric pressure ionization mass spectrometry apparatus (UG-302P produced by Renesas Eastern Japan) (hereinafter abbreviated as "APIMS Analysis Apparatus"). After placing a sample in a SUS316-made reactor tube kept at 23° C., an argon gas was caused to flow at a flow rate of 1.2 L/min. The argon gas having passed through the reactor tube was introduced into the APIMS where mass numbers associated with water ($18(H_2O^+)$, $19((H_2O)H^+)$, $37((H_2O)_2H^+)$, $55((H_2O)_3H^+)$) detected in the argon gas were measured for deriving a water release amount per unit area (the number of released water molecules [molecules/cm$^2$]) released from the sample.

The argon gas was discharged from the line for first 3 minutes after the argon gas started to flow, and the measurement was performed thereafter. When measuring a sample of each Example, after the lapse of 10 hours at 23° C., the temperature of the reactor tube started to be raised and, after reaching 200° C. (after 3 hours), was maintained at 200° C. for 2 hours, and the measurement was performed over this entire period. On the other hand, it was expected that since the water release amount of a sample of each Comparative Example was large, if measured in the same manner as in each Example, the measurable range of the water measuring apparatus would be exceeded. Accordingly, when measuring the sample of each Comparative Example, because of water release being large, 23° C. was maintained even after the lapse of 10 hours and the measurement was performed for the same time (15 hours in total) as that in each Example.

Example 11

Water Release Amount 1.8 g of adipic acid was dissolved into 39.5 g of water, then 158 g of ethylene glycol (EG) was added, and then stirring/mixing was carried out. While stirring this solution, 29% aqueous ammonia was added until the pH of the solution reached 7.1, thereby preparing an anodization solution b. In this anodization solution, an HQ2 sample piece of 20×8×1 mm was anodized at a constant current of 1 mA/cm$^2$ until reaching an anodization voltage of 200V and, after 200V was reached, the sample piece was anodized at the constant voltage for 30 minutes. After the reaction, it was sufficiently washed with pure water and then dried at room temperature. The obtained sample piece with an oxide film was annealed at 300° C. for 1 hour in the IR furnace and then opened to the atmosphere so as to be left standing at room temperature for 48 hours. The thickness of the barrier-type metal oxide film was measured to be 0.31 μm. No cracks were observed. The water release amount was measured to be 2E16 molecules/cm$^2$ or less. The results are shown in Table 5.

TABLE 5

| | Kind of Anodization Solution | Al Material | Current Density Jcc (mA/cm$^2$) | Voltage Vf (V) | Annealing Condition | Anodized Film Thickness (μm) | Anodized Film Crack | Anodized Film Water Release Amount (molecules/cm$^2$) |
|---|---|---|---|---|---|---|---|---|
| Example 11 | b | HQ2 | 1 | 200 | 300° C. 1 h | 0.31 | no | <2E16 |
| Example 12 | a | HQ2 | 1 | 200 | 300° C. 1 h | 0.32 | no | <2E16 |
| Example 13 | d | HQ2 | 1 | 200 | 300° C. 1 h | 0.30 | no | <2E16 |

Example 12

Water Release Amount 1.8 g of tartaric acid was dissolved into 39.5 g of water, then 158 g of ethylene glycol (EG) was added, and then stirring/mixing was carried out. An oxide film was formed in the same manner as in Example 11 except that, while stirring this solution, 29% aqueous ammonia was added until the pH of the solution reached 7.1, thereby preparing an anodization solution a. The thickness of the barrier-type metal oxide film was measured to be 0.32 μm. No cracks were observed. The water release amount was measured to be 2E16 molecules/cm$^2$ or less. The results are shown in Table 5.

Example 13

Water Release Amount 4.5 g of boric acid and 1.5 g of sodium borate were added to 194 g of water and stirring/mixing was carried out. The pH of this solution was measured to be 7.1. An oxide film was formed in the same manner as in Example 11 except preparing this anodization solution d. The thickness of the barrier-type metal oxide film was measured to be 0.32 μm. No cracks were observed.

The water release amount was measured to be 2E16 molecules/cm$^2$ or less. The results are shown in Table 5.

Example 14

1.8 g of adipic acid was dissolved into 39.5 g of water, then 158 g of ethylene glycol was added, and then stirring/mixing was carried out. While stirring this solution, 29% aqueous ammonia was added until the pH of the solution reached 7.0, thereby preparing an anodization solution b. In this anodization solution, an HQ0 sample piece of 20×8×1 mm was anodized at a constant current of 1 mA/cm$^2$ until reaching an anodization voltage of 200V and, after 200V was reached, the sample piece was anodized at the constant voltage for 30 minutes. The residual current density upon the completion of the constant-voltage reaction was 0.011 mA/cm$^2$. The results of Examples 14 to 19 and Reference Examples 1 to 4 are collectively shown in Table 6.

TABLE 6

| | Kind of Anodization Solution | Al Material | Residual Current (mA/cm$^2$) |
|---|---|---|---|
| Example 14 | b | HQ0 | 0.011 |
| Example 15 | b | HQ2 | 0.012 |
| Example 16 | b | HQ4.5 | 0.017 |
| Example 17 | c | HQ2 | 0.024 |
| Example 18 | a | HQ2 | 0.014 |
| Example 19 | d | HQ2 | 0.021 |
| Reference Example 1 | b | A5052 | 0.043 |
| Reference Example 2 | c | A5052 | 0.125 |
| Reference Example 3 | a | A5052 | 0.086 |
| Reference Example 4 | d | A5052 | 0.053 |

Examples 15 and 16

Oxide films were formed in the same manner as in Example 14 except using HQ2 and HQ4.5 as sample pieces, respectively. The residual current densities upon the completion of the constant-voltage reaction were 0.012 mA/cm$^2$ and 0.017 mA/cm$^2$, respectively.

Example 17

1.8 g of adipic acid was added to 197.5 g of water and stirring/mixing was carried out. While stirring this solution, 29% aqueous ammonia was added until the pH of the solution reached 7.0, thereby preparing an anodization solution c. An oxide film was formed in the same manner as in Example 14 except using HQ2 as a sample piece in this anodization solution. The residual current density upon the completion of the constant-voltage reaction was 0.024 mA/cm$^2$.

Example 18

1.8 g of tartaric acid was dissolved into 39.5 g of water, then 158 g of ethylene glycol (EG) was added, and then stirring/mixing was carried out. While stirring this solution, 29% aqueous ammonia was added until the pH of the solution reached 7.1, thereby preparing an anodization solution a. An oxide film was formed in the same manner as in Example 14 except using HQ2 as a sample piece in this anodization solution. The residual current density upon the completion of the constant-voltage reaction was 0.014 mA/cm$^2$.

Example 19

4.5 g of boric acid and 1.5 g of sodium borate were added to 194 g of water and stirring/mixing was carried out. The pH of this solution was measured to be 7.1. An oxide film was formed in the same manner as in Example 14 except using HQ2 as a sample piece in this anodization solution d. The residual current density upon the completion of the constant-voltage reaction was 0.021 mA/cm$^2$.

Reference Examples 1 to 4

Oxide films were formed in the same manner as in Example 14 except using A5052 aluminum sample pieces each of 20×8×1 mm in anodization solutions a to d, respectively. The results are shown in Table 6.

Figure 6:
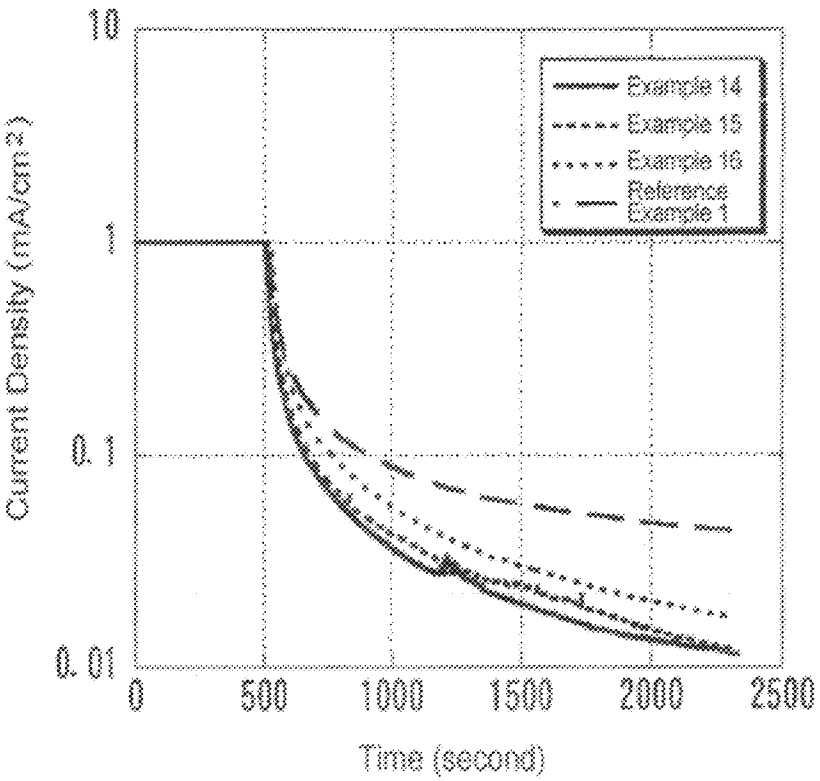
FIG. 6 is a graph showing the current characteristics during anodic oxidation in Examples 14 to 16 and Reference Example 1.

FIG. 6 shows changes in current density with the lapse of time during the anodic oxidation in Examples 14 to 16 and Reference Example 1. It is seen that, using, instead of A5052, the high-purity aluminum with the suppressed contents of the specific elements (iron, copper, manganese, zinc, and chromium) as the aluminum material for use in the anodic oxidation, the residual current density decreases regardless of the content concentration of magnesium or the presence of zirconium in each Example and, since this indicates that an ion current for repairing a defective portion in the metal oxide coating film caused by the anodic oxidation is small, the metal oxide coating film that is further excellent is formed.

Examples 20 and 21

Oxide films were formed in the same manner as in Example 15 except using HQ2 as sample pieces and anodizing them at constant currents of current densities 0.1 mA/cm$^2$ and 10 mA/cm$^2$, respectively. The residual current densities upon the completion of the constant-voltage reaction were 0.013 mA/cm$^2$ and 0.014 mA/cm$^2$, respectively. The results are shown in Table 7 along with reaching times required for reaching 200V after the start of the oxidation.

TABLE 7

| | Kind of Anodization Solution | Al Material | Current Density Jcc (mA/cm$^2$) | Anodic Oxidation Reaching Time (s) | Anodic Oxidation Residual Current (mA/cm$^2$) |
|---|---|---|---|---|---|
| Example 20 | b | HQ2 | 0.1 | 5713 | 0.013 |
| Example 15 | b | HQ2 | 1 | 512 | 0.012 |
| Example 21 | b | HQ2 | 10 | 44 | 0.014 |
| Comparative Example 5 | b | A5052 | 0.1 | 9686 | 0.036 |
| Comparative Example 1 | b | A5052 | 1 | 518 | 0.040 |
| Comparative Example 6 | b | A5052 | 10 | 55 | 0.047 |

Reference Examples 5 and 6

Oxide films were formed in the same manner as in Examples 20 and 21 except using A5052 as sample pieces. The residual current densities upon the completion of the constant-voltage reaction were 0.036 mA/cm$^2$ and 0.047 mA/cm$^2$, respectively. The results are shown in Table 7 along with reaching times required for reaching 200V after the start of the oxidation.

Figure 7:
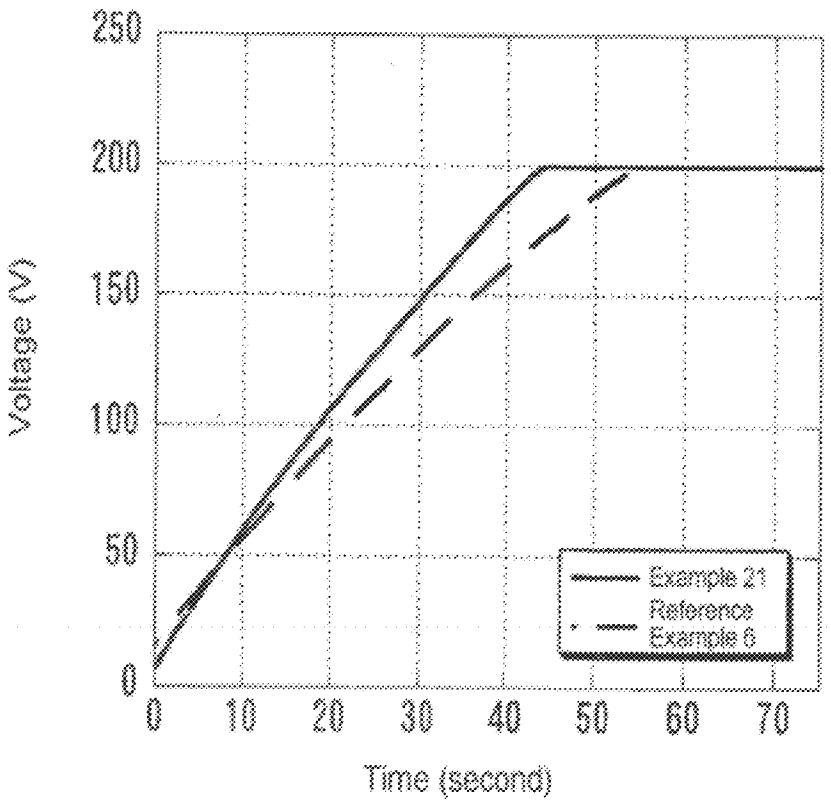
FIG. 7 is a graph showing the voltage characteristics during anodic oxidation in Example 21 and Reference Example 6.

It is seen that, using, instead of A5052, the high-purity aluminum with the suppressed contents of the specific elements (iron, copper, manganese, zinc, and chromium) as the aluminum material for use in the anodic oxidation, the residual current density decreases in each Example and thus the excellent metal oxide coating film is formed. FIG. 7 shows voltage changes with the lapse of time during the anodic oxidation in Example 21 and Reference Example 6. It is seen that, in Example 21 using the high-purity aluminum, the predetermined voltage was reached in a shorter time and thus the barrier-type metal oxide film can be formed at high throughput.

Examples 22 to 26

With respect to metal oxide coating films formed under the conditions of Examples 14 to 16, 20, and 21, respectively, the samples were, after the completion of the reaction, washed with pure water and then blow-dried with a nitrogen gas, and then were annealed at 300° C. for 1 hour in the IR furnace while causing a gas with a composition of nitrogen/oxygen=80/20 (vol ratio) to flow at a flow rate of 5 L/min. After the annealing, the samples were left standing so as to be cooled to room temperature and then, using an anodization solution b described in Table 1, the samples were anodized at a constant current of 0.1 mA/cm$^2$ until reaching an anodization voltage of 200V and, after 200V was reached, the samples were anodized at the constant voltage for 5 minutes, thereby carrying the anodic oxidation again. Table 8 shows the results about residual current densities upon the completion of the constant-voltage reaction and reaching times required for reaching 200V after the start of the oxidation.

TABLE 8

| | Kind of Anodization Solution | Al Material | Current Density Jcc (mA/cm$^2$) | Anodic Oxidation Reaching Time (s) | Anodic Oxidation Residual Current (mA/cm$^2$) |
|---|---|---|---|---|---|
| Example 22 | b | HQ0 | 1 | 1 | 0.0003 |
| Example 23 | b | HQ2 | 0.1 | 52 | 0.0026 |
| Example 24 | b | HQ2 | 1 | 8 | 0.0009 |
| Example 25 | b | HQ2 | 10 | 12 | 0.0015 |
| Example 26 | b | HQ4.5 | 1 | 6 | 0.0031 |
| Comparative Example 7 | b | A5052 | 0.1 | 532 | 0.0435 |
| Comparative Example 8 | b | A5052 | 1 | 292 | 0.0396 |
| Comparative Example 9 | b | A5052 | 10 | 140 | 0.0397 |

Reference Examples 7 to 9

Reanodization was performed after annealing in the same manner as in Examples 22 to 26 except using metal oxide coating films formed under the conditions of Reference Examples 1, 5, and 6, respectively. Table 8 shows the results about residual current densities upon the completion of the constant-voltage reaction and reaching times required for reaching 200V after the start of the oxidation.

It is seen that, using, instead of A5052, the high-purity aluminum with the suppressed contents of the specific elements (iron, copper, manganese, zinc, and chromium) as the aluminum material for use in the anodic oxidation, if the reanodization is performed after the annealing, the predetermined voltage is reached in a short time in each of Examples 22 to 26 and, simultaneously, the residual current density is reduced by one digit as compared with that at the time of the initial formation of the metal oxide coating film, and thus, by performing the annealing, the barrier-type metal oxide coating film that is more excellent in quality is formed.

On the other hand, in each of Reference Examples 7 to 9 using A5052 as the aluminum material, if the reanodization is performed after the annealing, a considerable time is required for reaching the predetermined voltage. It is conjectured that if the specific elements (iron, copper, manganese, zinc, and chromium) are contained in the aluminum material, voids including high-pressure gas are formed near the interface between the barrier-type metal oxide coating film and the metal and, through expansion thereof due to the heat of the annealing, cause occurrence of microcracks or the like in the barrier-type metal oxide coating film, so that the reanodization takes a long time for repairing the cracks and the residual current density stays approximately equivalent to that at the time of the initial formation of the metal oxide coating film.

Examples 27 to 32

Anodized films were formed using an anodization solution b described in Table 1 in the same manner as in Example 14 except using HQ2 and A5052 as sample pieces. The samples were, after the completion of the reaction, washed with pure water and then blow-dried with a nitrogen gas, and then were annealed at 300° C. for 1 hour in the IR furnace while causing a gas with a composition of nitrogen/oxygen=80/20 (vol ratio) to flow at a flow rate of 5 L/min. The obtained samples were immersed in respective chemical solutions described in Table 9 at room temperature for 10 minutes, then washed with pure water, and then blow-dried with a nitrogen gas.

Each sample was reanodized using the anodization solution b of Table 1 at a current density of 0.1 mA/cm$^2$ and the etching amount of each barrier-type metal oxide coating film by the corresponding chemical solution was calculated from the amount of coulomb required for a voltage to reach 200V, thereby deriving the etching amount ratio of the high-purity aluminum material to the A5052 material. The results are shown in Table 9.

TABLE 9

(Chemical Solution Resistance)

| | Kind of Anodization Solution | Chemical Solution Name | Chemical Solution Concentration | Etching Amount (nm) HQ2 Material | Etching Amount (nm) A5052 Material | Etching Amount Ratio HQ2 Material/A5052 Material |
|---|---|---|---|---|---|---|
| Example 27 | b | HNO3 | 1% | 0.2 | 25.1 | 0.01 |
| Example 28 | b | HNO3 | 30% | 20.5 | 86.2 | 0.24 |
| Example 29 | b | HNO3 | 70% | 1.7 | 35.7 | 0.05 |
| Example 30 | b | HF/H2O2 | 10 ppm | 1.9 | 26.9 | 0.07 |
| Example 31 | b | HF/H2O2 | 100 ppm | 20.6 | 129.7 | 0.16 |
| Example 32 | b | HF/H2O2 | 1000 ppm | 205.3 | 289.3 | 0.71 |

Figure 8:
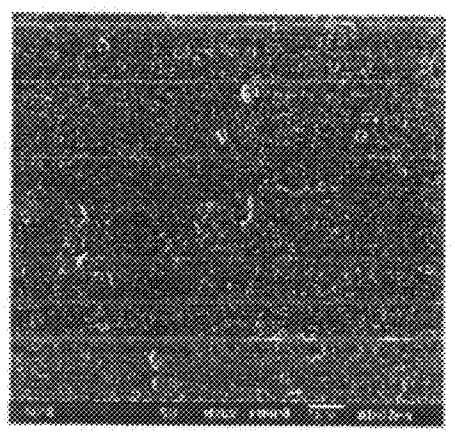
FIG. 8 is electron microscope photographs of the surfaces of samples of a high-purity aluminum material and an A5052 material after immersion in a chemical solution in Example 30.
Figure 8:
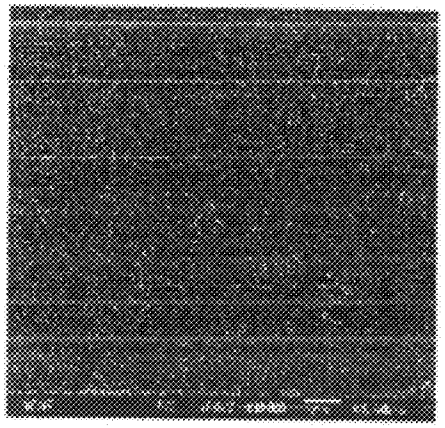

FIG. 8 shows the surface states after the chemical solution treatment in Example 30.

As described above, the barrier-type metal oxide coating film of the high-purity aluminum material is less than 1 in etching amount ratio to the A5052 material and thus has a higher corrosion resistance with respect to any chemical solution kinds and concentrations.

Examples 33 and 34

Oxide films were formed using anodization solutions b and d described in Table 1, respectively, in the same manner as in Example 14 except using HQ2 and A5052 as sample pieces. The samples were, after the completion of the reaction, washed with pure water and then blow-dried with a nitrogen gas, and then were annealed at 300° C. for 1 hour in the IR furnace while causing a gas with a composition of nitrogen/oxygen=80/20 (vol ratio) to flow at a flow rate of 5 L/min. The obtained samples were weighed by the precision electron balance and then exposed to a chlorine gas in the reactor tube at 200° C. for 6 hours.

After the exposure, the weight of each sample was weighed by the precision electron balance to calculate a weight reduction rate of each metal oxide coating film, thereby deriving a weight reduction rate ratio of the high-purity aluminum material to the A5052 material. The results are shown in Table 10.

TABLE 10

(Chlorine Gas Resistance)

| | Kind of Anodization Solution | Chlorine Gas Resistance: Gas Kind | Gas Concentration (wt %) | Weight Reduction Rate (wt %) HQ2 Material | Weight Reduction Rate (wt %) A5052 Material | Weight Reduction Rate Ratio HQ2 Material/A5052 Material |
|---|---|---|---|---|---|---|
| Example 33 | b | $Cl_2$ | 100 | 0.01 | 0.20 | 0.05 |
| Example 34 | d | $Cl_2$ | 100 | 0.40 | 1.77 | 0.23 |

Figure 9:
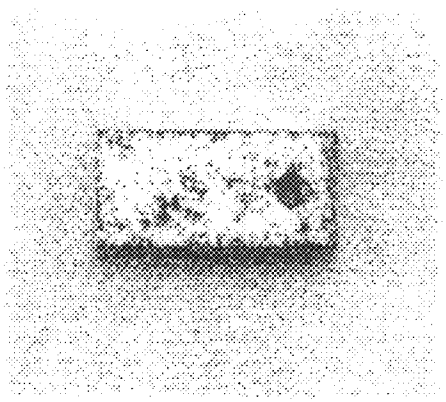
FIG. 9 is photographs of the surfaces of samples of a high-purity aluminum material and an A5052 material after chlorine-gas exposure evaluation in Example 33.
Figure 9:
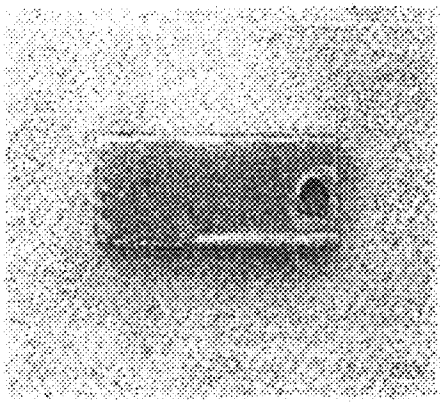

FIG. 9 shows the surface states after the chemical solution treatment in Example 33.

As described above, each barrier-type metal oxide coating film of the high-purity aluminum material is less than 1 in chlorine-gas exposure weight reduction rate ratio to the barrier-type metal oxide coating film of the A5052 material and thus has a higher corrosion resistance against the chlorine gas. Further, the metal oxide coating film obtained using the anodization solution b has a higher corrosion resistance as compared with the metal oxide coating film obtained using the anodization solution d.

Next, other features of this invention will be described based on experimental data.

Figure 10:
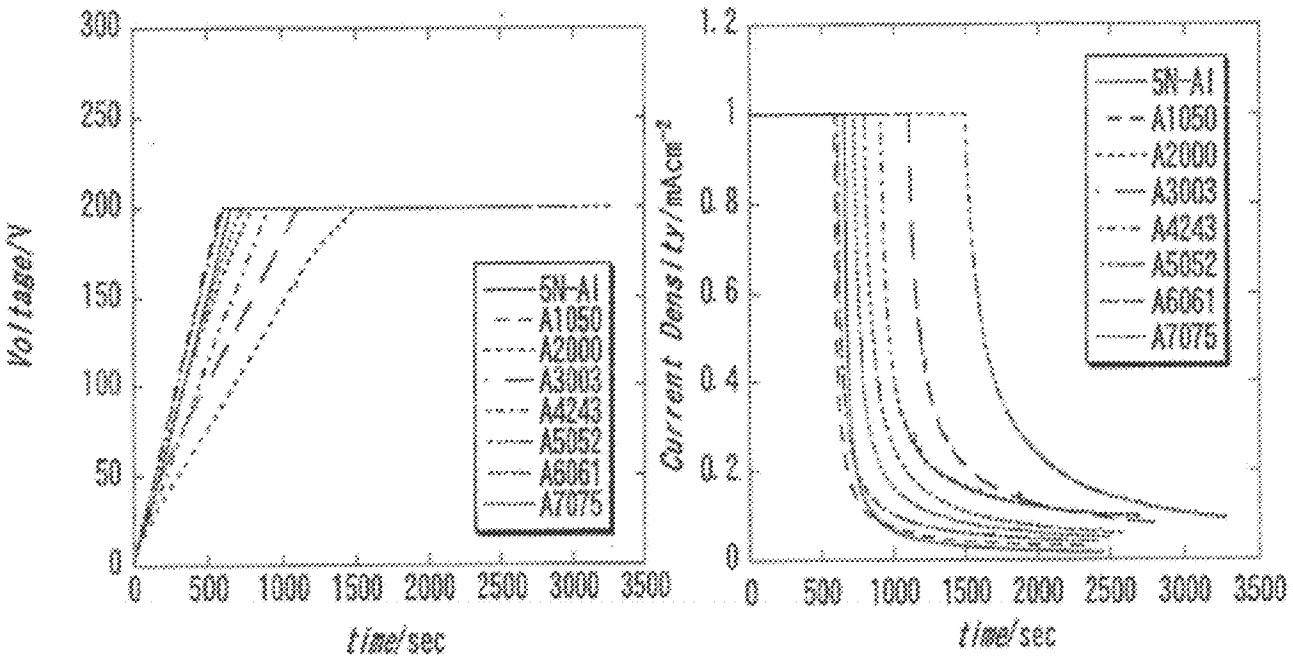
FIG. 10 shows the characteristics when anodizing pure Al and various Al alloys shown in Table 11 using a nonaqueous electrolyte solution containing 1 wt % ammonium adipate, wherein FIG. 10 (*a*) is a graph showing the voltage characteristics and FIG. 10 (*b*) is a graph showing the current characteristics.

Table 11 shows compositions of pure Al and various Al, FIG. 10(*a*) shows the voltage characteristics when anodizing these Al using a nonaqueous electrolyte solution (containing 1 mass % adipic acid), and FIG. 10(*b*) shows the current characteristics.

TABLE 11

Component Composition and Content of Aluminum Alloy

| Al, Al-alloy | composition element (wt %) Cu | Fe | Cr | Mn | Si | Mg | total content (wt %) Σ [Cu, Fe, Cr, Mn, Si] |
|---|---|---|---|---|---|---|---|
| 5N-Al | 0.00 | 0.00 | 0.00 | 0.00 | 0.00 | 0.00 | 0.00 |
| A1050 | 0.02 | 0.35 | 0.00 | 0.00 | 0.06 | 0.00 | 0.43 |
| A2000 | 4.90 | 0.50 | 0.10 | 0.90 | 0.50 | ? | 6.90 |
| A3003 | 0.13 | 0.55 | 0.00 | 1.07 | 0.30 | 0.01 | 2.05 |
| A4243 | 0.01 | 0.30 | 0.00 | 0.03 | 7.52 | 0.00 | 7.86 |
| A5052 | 0.10 | 0.41 | 0.35 | 0.09 | 0.25 | 2.51 | 1.20 |
| A6061 | 0.27 | 0.42 | 0.26 | 0.03 | 0.57 | 0.97 | 1.55 |
| A7075 | 1.40 | 0.33 | 0.21 | 0.01 | 0.08 | 2.77 | 2.03 |

Figure 11:
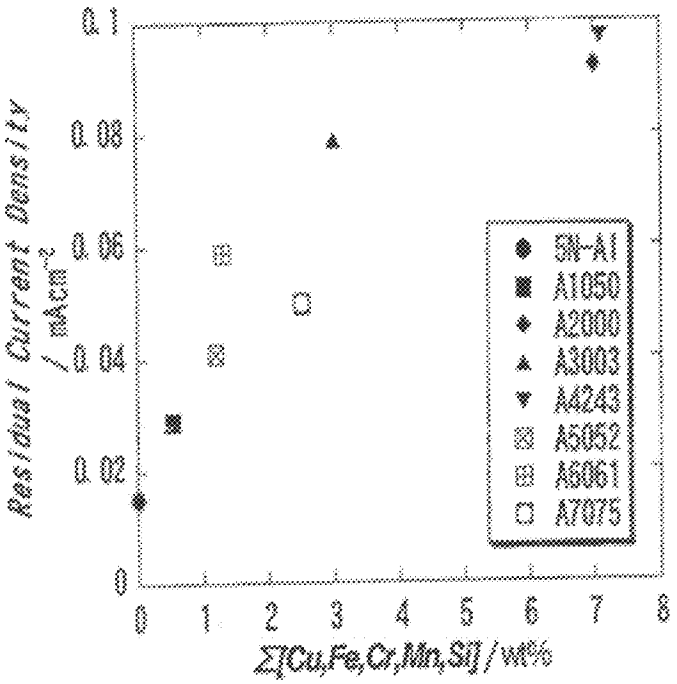
FIG. 11 is a graph showing the residual current densities of various aluminum alloys formed using a nonaqueous electrolyte solution containing 1 wt % ammonium adipate.

FIG. 11 shows residual current values after the anodic oxidation in relation to the total contents of impurities (Cu, Fe, Cr, Mn, Si) in the Al alloys. It is seen from FIG. 11 that the total content of the impurities is preferably 1 mass % or less. These impurities, when oxidized, aggregate at the interface between an oxide film and Al and produce an oxygen gas by its catalytic action, thereby worsening the residual current value and causing cracks in the oxide film during annealing.

Figure 12:
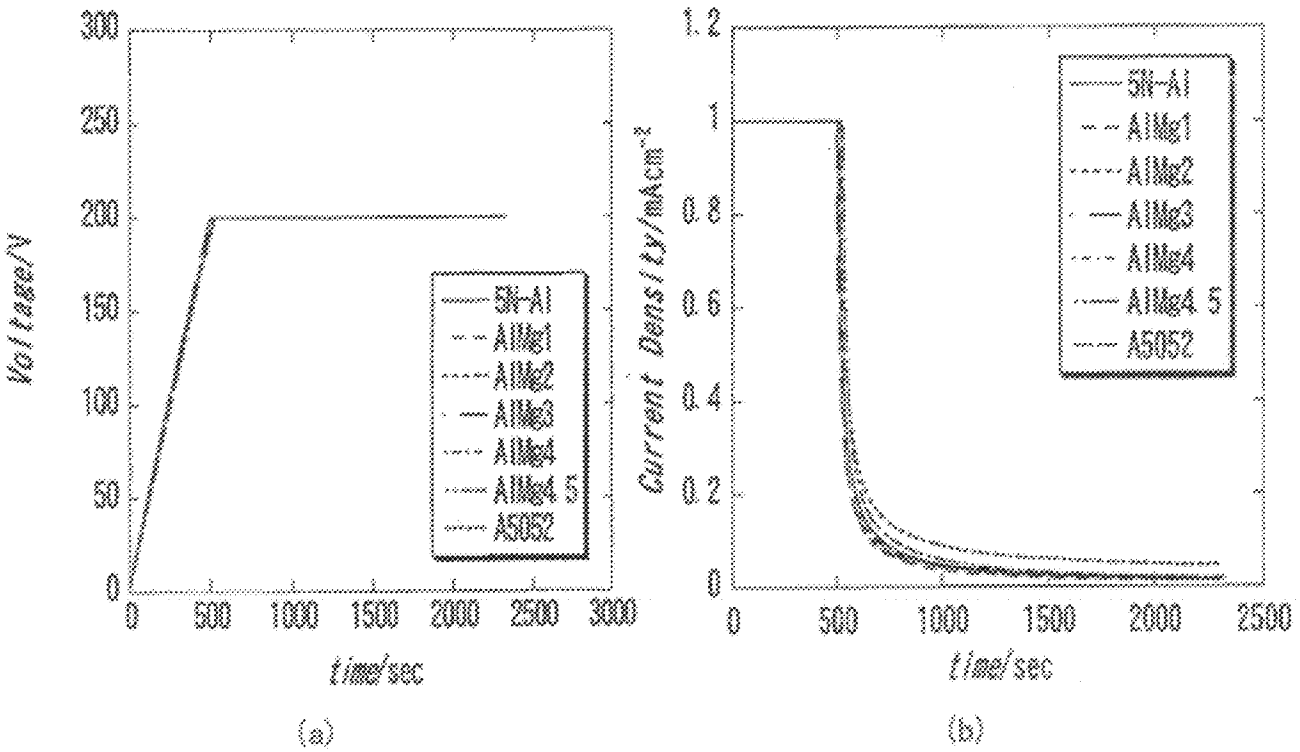
FIG. 12 shows the results of anodizing, with a nonaqueous electrolyte solution containing 1 wt % ammonium adipate, high-purity Al containing Mg and Zr in small quantities and having compositions shown in Table 12, wherein FIG. 12 (*a*) is a graph showing the voltage characteristics and FIG. 12 (*b*) is a graph showing the current characteristics.

FIG. 12 shows the results of anodizing, in the same manner with a nonaqueous solution, high-purity Al containing Mg and Zr in small quantities and having compositions shown in Table 12. FIG. 12(*a*) shows the voltage characteristics and FIG. 12(*b*) shows the current characteristics. In the voltage characteristics, the voltage linearly increases to a predetermined voltage with respect to all the samples. In the current characteristics, the current reaches a sufficiently low residual current with respect to each sample except A5052.

TABLE 12

Component Composition and Content of High-Purity Aluminum Alloy

| Al alloy | composition element (wt %) Cu | Fe | Cr | Mn | Si | Zr | Mg | total content (wt %) Σ [Cu, Fe, Cr, Mn, Si] |
|---|---|---|---|---|---|---|---|---|
| AlMg1 | 0.00 | 0.00 | 0.00 | 0.00 | 0.00 | 0.11 | 0.99 | 0.00 |
| AlMg2 | 0.00 | 0.00 | 0.00 | 0.00 | 0.01 | 0.11 | 2.03 | 0.01 |
| AlMg3 | 0.00 | 0.00 | 0.00 | 0.00 | 0.01 | 0.11 | 3.05 | 0.01 |
| AlMg4 | 0.00 | 0.00 | 0.00 | 0.00 | 0.01 | 0.11 | 4.05 | 0.01 |
| AlMg4.5 | 0.00 | 0.00 | 0.00 | 0.00 | 0.01 | 0.11 | 4.55 | 0.01 |

Figure 13:
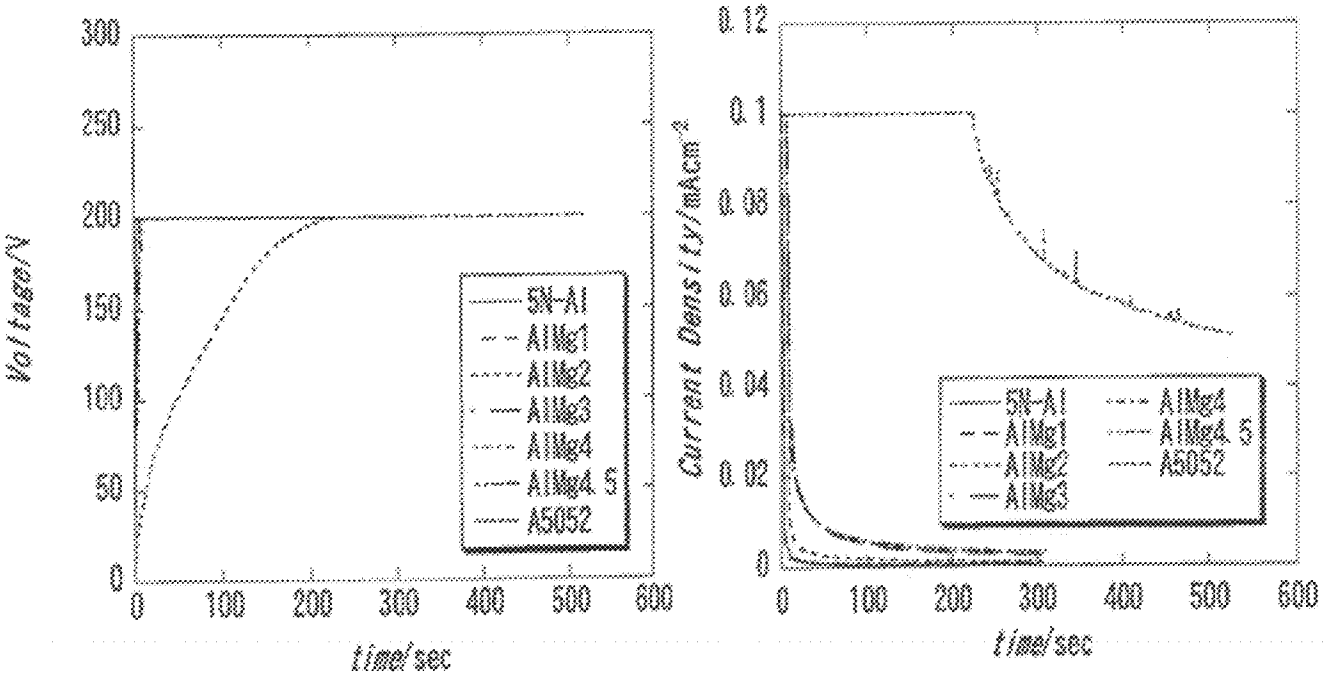
FIG. 13 relates to reanodization for evaluating oxide films after annealing and shows reanodization curves of aluminum alloys after annealing at 573(K), wherein FIG. 13 (*a*) and FIG. 13 (*b*) are graphs respectively showing the voltage characteristics and the current characteristics.
Figure 14:
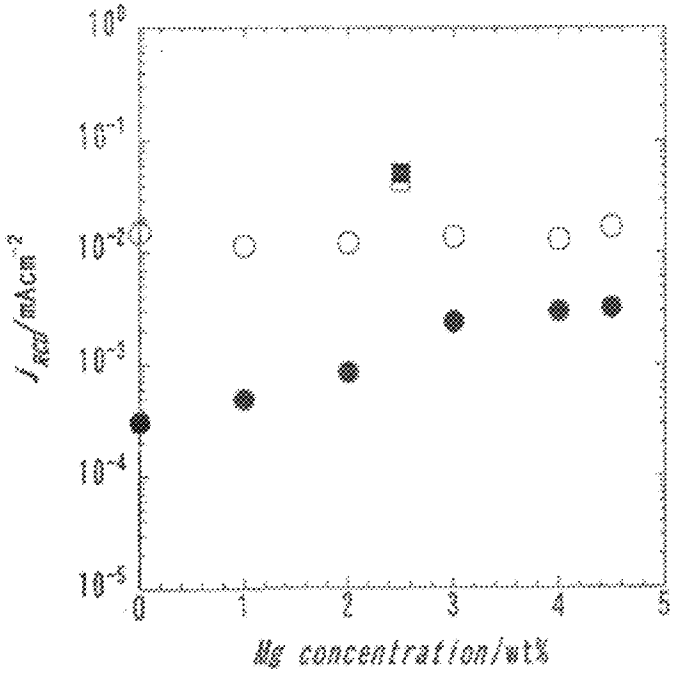
FIG. 14 is a graph showing residual current values before and after the annealing/reoxidation.

After the anodic oxidation of FIG. 12, the samples were washed with pure water, dried in a nitrogen gas, and annealed at 300° C. for 1 hour. The annealing was carried out by causing a mixed gas containing an oxygen gas and a nitrogen gas in a volume ratio of 20:80 to flow at a flow rate of 5 liters per min. Reanodization was performed for evaluating oxide films after the annealing. FIG. 13(*a*), (*b*) respectively show the voltage characteristics and the current characteristics and FIG. 14 show residual current values before and after the annealing/reoxidation. In the changes in residual current density shown in FIG. 14, mark ○ concerns pure Al and high-purity Al—Mg alloys after anodic oxidation, mark • concerns pure Al and high-purity Al—Mg alloys after annealing and reanodization, mark □ concerns A5052 alloy after anodic oxidation, and black square concerns A5052 alloy after annealing and reanodization. It is seen that the residual current values strikingly decrease by the annealing/reoxidation. This is because the insulating properties of the oxide films are largely improved. With respect to A5052, cracks are generated in the oxide film due to the annealing or the like to degrade the properties.

Figure 15:
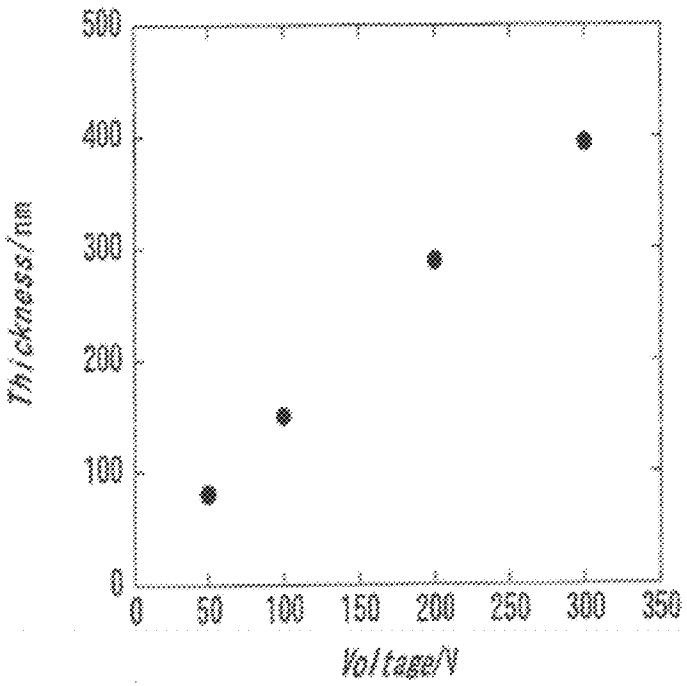
FIG. 15 is a graph showing the relationship between voltage and oxide film thickness in anodic oxidation.

FIG. 15 shows the relationship between voltage and anodized film thickness in anodic oxidation of AlMg2 (Al—Mg2 wt %-Zr0.1 wt %). It is seen that the thickness increases substantially in proportion to the voltage as the voltage becomes higher.

Figure 16:
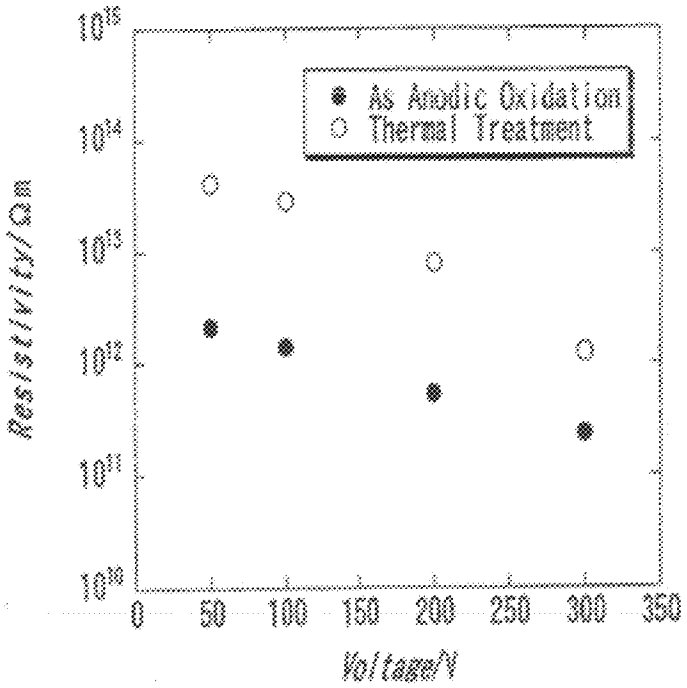
FIG. 16 is a graph showing the relationship between anodization voltage and oxide film resistivity.

FIG. 16 shows the relationship between anodization voltage and oxide film resistivity in anodic oxidation of AlMg2 (Al—Mg2 wt %-Zr0.1 wt %). The resistivities are all 1E11 or more and the resistivity increases by 10 to 50 times by the annealing/reoxidation.

Figure 17:
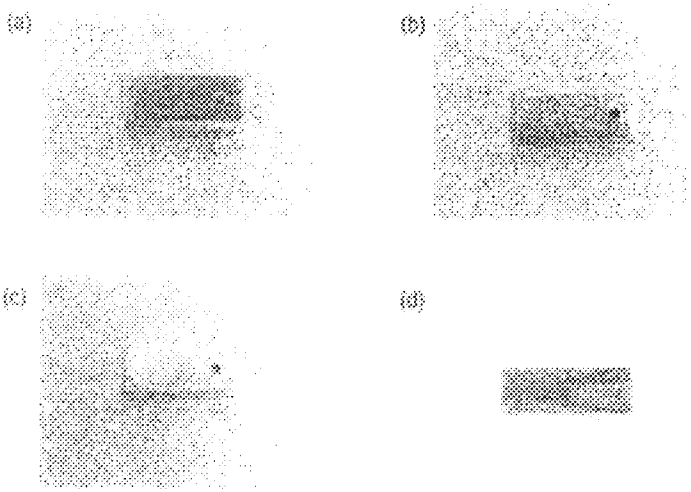
FIG. 17 are electron microscope photographs showing the states (a), (b), (c) where AlMg2 samples annealed at 300° C. for 1 hour after anodic oxidation are exposed to an ammonia gas, a chlorine gas, and an HBr gas at 200° C., respectively, along with the state (d) where an alumite is exposed to a chlorine gas at 100° C.

FIG. 17(*a*), (*b*), (c) show the states where AlMg2 samples with anodized films annealed at 300° C. for 1 hour after anodic oxidation are exposed to an ammonia gas, a chlorine gas, and an HBr gas at 200° C., respectively, along with the state of (d) where an alumite is exposed to a chlorine gas at 100° C. These states are after the exposure to the gases at 0.3 MPa for 6 hours. It is seen that the oxide films of this invention are not damaged.

Figure 18:
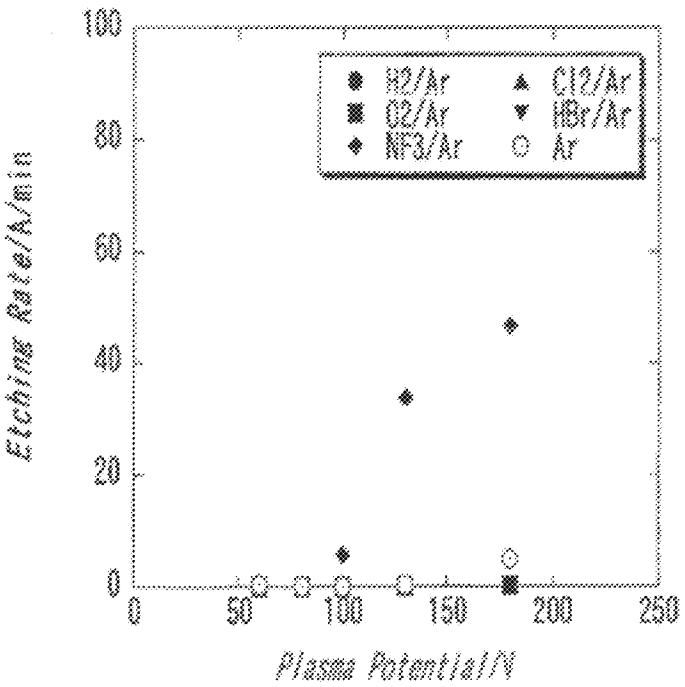
FIG. 18 is a graph showing the results of exposing AlMg2 samples annealed at 300° C. for 1 hour after anodic oxidation to irradiated ions.

FIG. 18 shows corrosion resistance properties representing the results of exposing AlMg2 samples annealed at 300° C. for 1 hour after anodic oxidation to irradiated ions. The axis of abscissas represents the ion implantation energy in terms of plasma potential and the axis of ordinates represents the corresponding etching rate. It is seen that, at a plasma potential of 100V, the anodized films of this invention have complete resistance against various radicals such as hydrogen radicals, oxygen radicals, chlorine radicals, bromine radicals, and fluorine radicals and against ion irradiation in a plasma.

Figure 19:
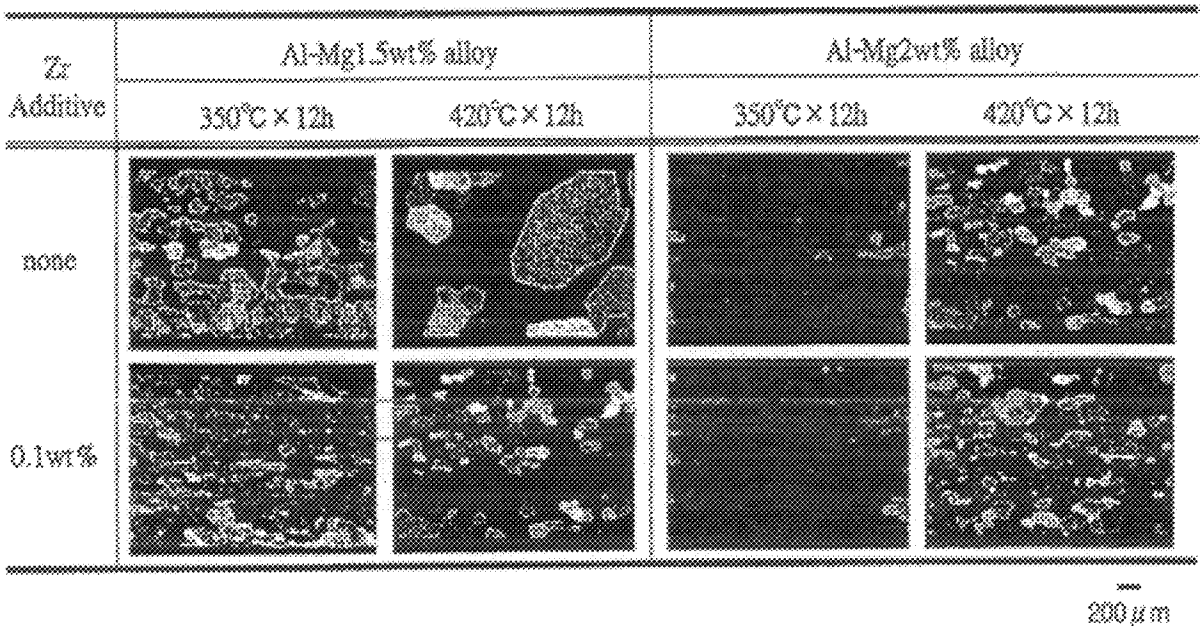
FIG. 19 is a diagram showing the growth of Al crystal grains with respect to the case where Zr is added in an amount of 0.1 mass % to high-purity Al (the total content of impurities is 100 ppm or less) containing 1.5 mass % Mg and to high-purity Al containing 2 mass % Mg, and with respect to the case where Zr is not added.

FIG. 19 shows the effect achieved when Zr is added in an amount of 0.1 mass % to high-purity Al (the total content of impurities is 100 ppm or less) containing Mg, suitable for use in this invention, in an amount of 1.5 mass % and to high-purity Al containing 2 mass % Mg, and also shows the case where Zr is not added. It is seen that the growth of Al crystal grains is suppressed by the addition of Zr. It is also seen that the addition of 2% Mg has a similar effect.

INDUSTRIAL APPLICABILITY

As described above, according to this invention, it is possible to provide a metal oxide film containing aluminum as the main component, particularly a barrier-type metal oxide film with no fine holes or pores, and a manufacturing method thereof. This metal oxide film and a laminate having it exhibit excellent corrosion resistance against chemicals and halogen gases, particularly a chlorine gas. Further, since cracks hardly occur in the metal oxide film even when heated, it is possible to suppress generation of particles and corrosion due to exposure of the aluminum base body, thermal stability is high, and release of outgas from the film is small in amount. If it is used as a protective film of a structural member such as an inner wall of a vacuum apparatus such as a vacuum thin-film forming apparatus, the ultimate vacuum of the apparatus is improved and the quality of thin films manufactured is improved, thus leading to reduction in operation failure of devices having the thin films.

Further, according to a metal oxide film manufacturing method of this invention, it is possible to efficiently form a pore-free metal oxide film with a high withstand voltage in which cracks hardly occur during heating. This metal oxide film is suitable as a protective coating film for the surface of a metal base member and further it can be used as an impurity shielding coating film or an anticorrosive coating film, and thus, its application range is wide.

The invention claimed is:

1. A metal oxide film manufacturing method for manufacturing an amorphous barrier metal oxide film for use as a coating film for protecting a structural member of a semiconductor or flat panel display manufacturing apparatus, said method comprising:

anodizing a metal or metal alloy containing aluminum as a main component in an anodization solution of pH 4 to 10 and at an anodization voltage of 150V or greater, thereby obtaining the amorphous barrier metal oxide film on the structural member of a semiconductor or the flat panel display manufacturing apparatus formed of an oxide of the metal or metal alloy containing aluminum as the main component, wherein the anodization solution comprises mainly at least one nonaqueous solvent selected from the group consisting of ethylene glycol, diethylene glycol, triethylene glycol, and tetraethylene glycol and the ratio of water to the nonaqueous solvent is 40 mass % or less based on the total amount of water and the total amount of the non-aqueous solvent, and wherein the anodization solution further comprises at least one electrolyte selected from the group consisting of boric acid, phosphoric acid, organic carboxylic acid, and salts thereof, and wherein said metal or metal alloy containing aluminum has a total content of iron, copper, manganese, zinc, and chromium of 0.01 mass % or less, wherein said amorphous barrier metal oxide film has a thickness of 10 nm to 1 μm and a water release amount from said amorphous barrier metal oxide film is 1E18 molecules/$cm^2$ or less.

2. A laminate manufacturing method for manufacturing a laminate for use as a structural member of a semiconductor or flat panel display manufacturing apparatus, said method comprising:

anodizing a base body made of a metal or metal alloy containing aluminum as a main component in an anodization solution of pH 4 to 10 and at an anodization voltage of 150V or greater, thereby forming barrier metal oxide film on the structural member of a semiconductor or the flat panel display manufacturing apparatus, wherein the amorphous barrier metal oxide film is made of an oxide of the metal or metal alloy containing aluminum as the main component on said base body, wherein the anodization solution comprises mainly at least one nonaqueous solvent selected from the group consisting of ethylene glycol, diethylene glycol, triethylene glycol, and tetraethylene glycol and the ratio of water to the nonaqueous solvent is 40 mass % or less based on the total amount of water and the total amount of the non-aqueous solvent, and wherein the anodization solution further comprises at least one electrolyte selected from the group consisting of boric acid, phosphoric acid, organic carboxylic acid, and salts thereof, and wherein said metal or metal alloy containing aluminum has a total content of iron, copper, manganese, zinc, and chromium is 0.01 mass % or less, wherein said amorphous barrier metal oxide film has a thickness of 10 nm to 1 μm and a water release amount from said amorphous barrier metal oxide film is 1E18 molecules/$cm^2$ or less.

3. The metal oxide film manufacturing method according to claim 1, wherein said anodization solution comprises adipic acid.

4. The metal oxide film manufacturing method according to claim 1, wherein said anodization solution has a pH of 6 to 8.

5. The laminate manufacturing method according to claim 2, wherein said anodization solution comprises adipic acid.

6. The laminate manufacturing method according to claim 2, wherein said anodization solution has a pH of 6 to 8.

7. A metal oxide film manufacturing method for manufacturing an amorphous metal oxide film for use as a coating film for protecting a structural member of a semiconductor or flat panel display manufacturing apparatus, said method comprising:

anodizing a metal or metal alloy member including aluminum as a main component in an anodization solution comprising mainly at least one non-aqueous solvent selected from the group consisting of ethylene glycol, diethylene glycol, triethylene glycol, and tetraethylene glycol of pH 4 to 10 by applying a voltage not lower than 150 V, to obtain the amorphous metal oxide film including aluminum as the main component, wherein the anodizing comprises:

a first step of placing said metal or metal alloy member and an opposed electrode in said anodization solution;

a second step of applying an anodization voltage between the metal or metal alloy member and the opposed electrode until an electric current reaches a constant current between a range of 0.01 and 100 mA per square centimeter;

a third step of maintaining the anodization voltage between the metal or metal alloy member and the opposed electrode for a predetermined period of time; and a fourth step of heat-treating said metal or metal alloy member at a predetermined temperature of from 150° C. to 600° C.

8. The metal oxide film manufacturing method according to claim 7, wherein the ratio of water to the nonaqueous solvent is 40 mass % or less based on the total amount of water and the total amount of the non-aqueous solvent, wherein the anodization solution further comprises at least one electrolyte selected from the group consisting of boric acid, phosphoric acid, organic carboxylic acid, and salts thereof, and wherein said amorphous metal oxide film has a thickness of 10 nm to 1 μm and a water release amount from said amorphous metal oxide film is 1E18 molecules/$cm^2$ or less.

9. The metal oxide film manufacturing method according to claim 7, wherein said anodization solution comprises adipic acid.

10. The metal oxide film manufacturing method according to claim 7, wherein said anodization solution has a pH of 6 to 8.

11. The metal oxide film manufacturing method according to claim 7, wherein the anodizing forms a pore-free metal oxide film having an entirely amorphous structure.

* * * * *